US005619477A

United States Patent [19]

Schenk

[11] Patent Number: 5,619,477

[45] Date of Patent: Apr. 8, 1997

[54] CLOCK WITH TARGET TIME ENTRY SYSTEM

[76] Inventor: U. Martin Schenk, Grabenstrasse 45/55, A-8010, Graz, Austria

[21] Appl. No.: 193,102

[22] PCT Filed: Aug. 10, 1992

[86] PCT No.: PCT/EP92/01819

§ 371 Date: Feb. 8, 1994

§ 102(e) Date: Feb. 8, 1994

[87] PCT Pub. No.: WO93/03428

PCT Pub. Date: Feb. 18, 1993

[30] Foreign Application Priority Data

Aug. 8, 1991 [DE] Germany ..... 41 26 323.5

[51] Int. Cl.[6] ..... G04B 47/00; G04B 19/24; G04B 45/00

[52] U.S. Cl. ..... 368/10; 368/29; 368/73; 368/187; 368/223

[58] Field of Search ..... 368/101, 41–43, 368/72–75, 82–84, 185–187, 223, 239, 250, 251

[56] References Cited

U.S. PATENT DOCUMENTS

| | | | |
|---|---|---|---|
| 4,456,385 | 6/1984 | Hattori . | |
| 4,712,923 | 12/1987 | Martin | 368/10 |
| 4,769,796 | 9/1988 | Levine | 368/29 |
| 4,896,307 | 1/1990 | Marx et al. | 368/70 |
| 5,199,009 | 3/1993 | Svast | 368/240 |
| 5,365,494 | 11/1994 | Lynch | 368/10 |

FOREIGN PATENT DOCUMENTS 342916 4/1991 European Pat. Off. .

*Primary Examiner*—Vit W. Miska

*Attorney, Agent, or Firm*—Bardehle, Pagenberg, Dost, Altenburg, Frohwitter, Geissler & Partners

[57] ABSTRACT

A clock has at least one display unit for the real time, at least one input unit for at least one adjustable set-time, if necessary linked to a date, that can be stored in a memory and that triggers a process when it is attained, as well as at least one display unit for the set-time(s). The input unit has at least three main input means. Each main input means allows a moment in time located in the future with respect to the time presently displayed in the set-time display unit to be reached, starting from the real time or from an adjusted set-time that has been programmed immediately beforehand with the same or another main input means. Said future moment in time represents an integral multiple or an integral fraction of an hour and/or the beginning of an explicitly named set period in time adapted to our natural time perception conditioned by culture and tradition.

12 Claims, 19 Drawing Sheets

Fig 19a
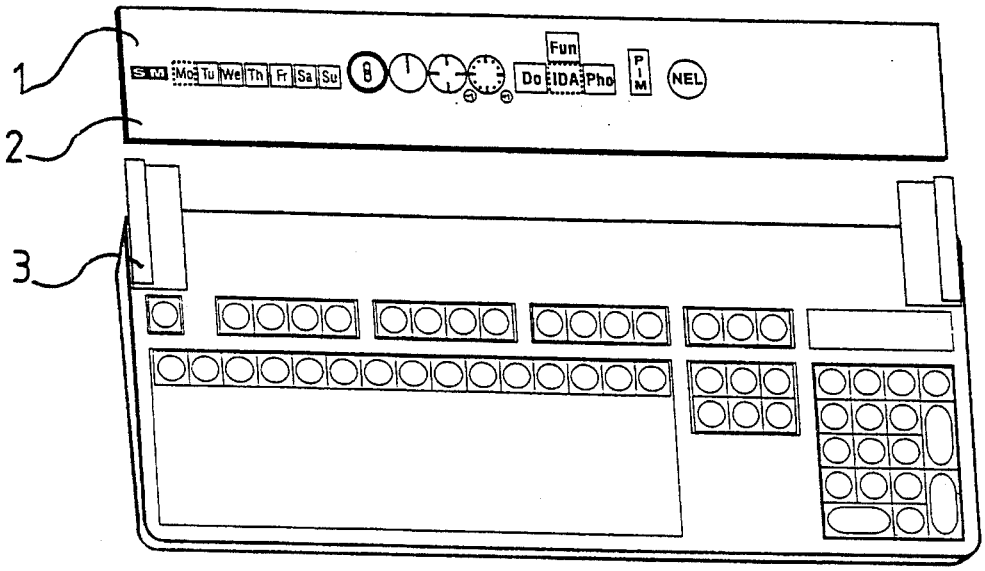
Fig 19b
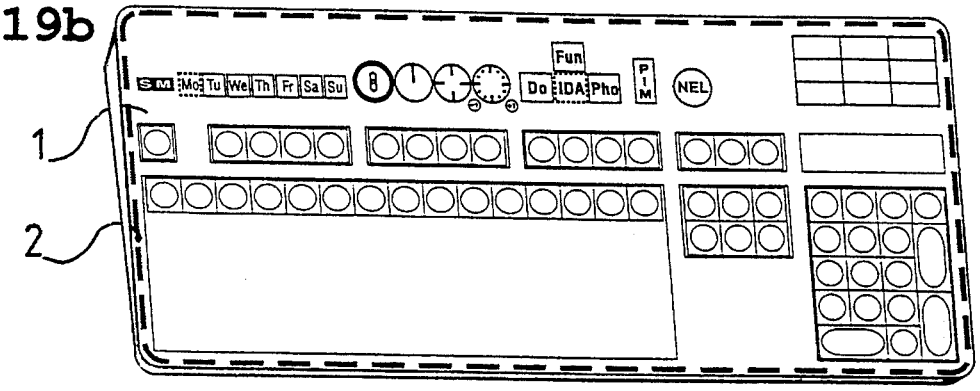
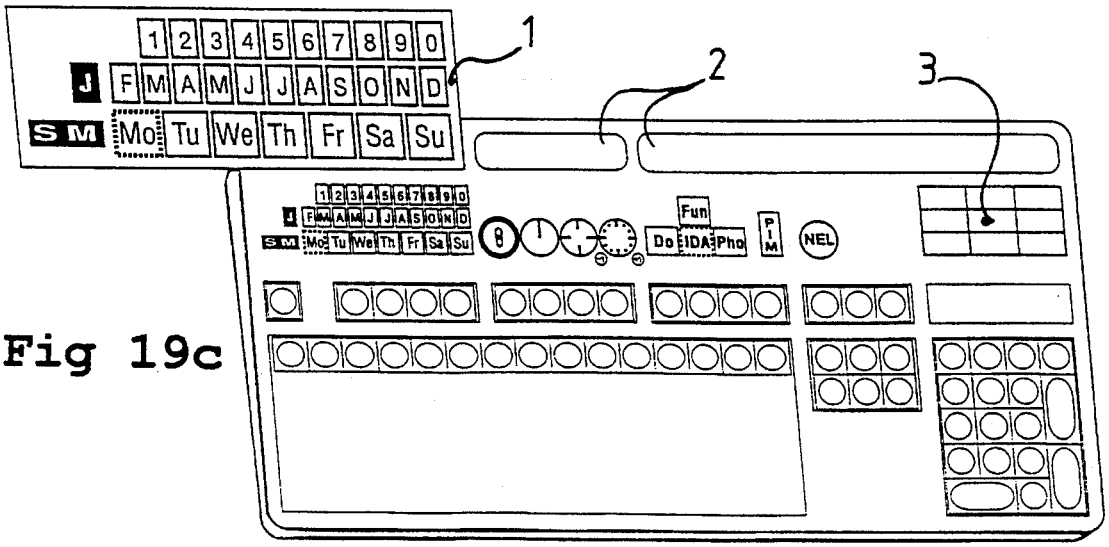
Fig 19c

Th. 6. Oct. 10:08

We. 7. Oct. 8:08

| S M | 1 | 2 | 3 | 4 | 5 | 6 | 7 | 8 |
|---|---|---|---|---|---|---|---|---|
| 1 | ♩ | it is as early as | 8:00 a.m. | long time still | before | taking medicine | 5 hs. left | |
| 2 | | it is as late as | 12:45 p.m. | left only | before | taking medicine | 15 min. left | ♩ |
| 3 | ♩ | it is now | 1:00 p.m. | now | you scheduled | taking medicine | at 1 p.m. | |
| 4 | | it is as late as | 1:13 p.m. | you wanted | to take medicine | on time | at 1 p.m. | ♩ |
| 5 | ♩ | it is as late as | 14:00 p.m. | you wanted | to take medicine | on time | at 1 p.m. | ♩ |

Fig 16a
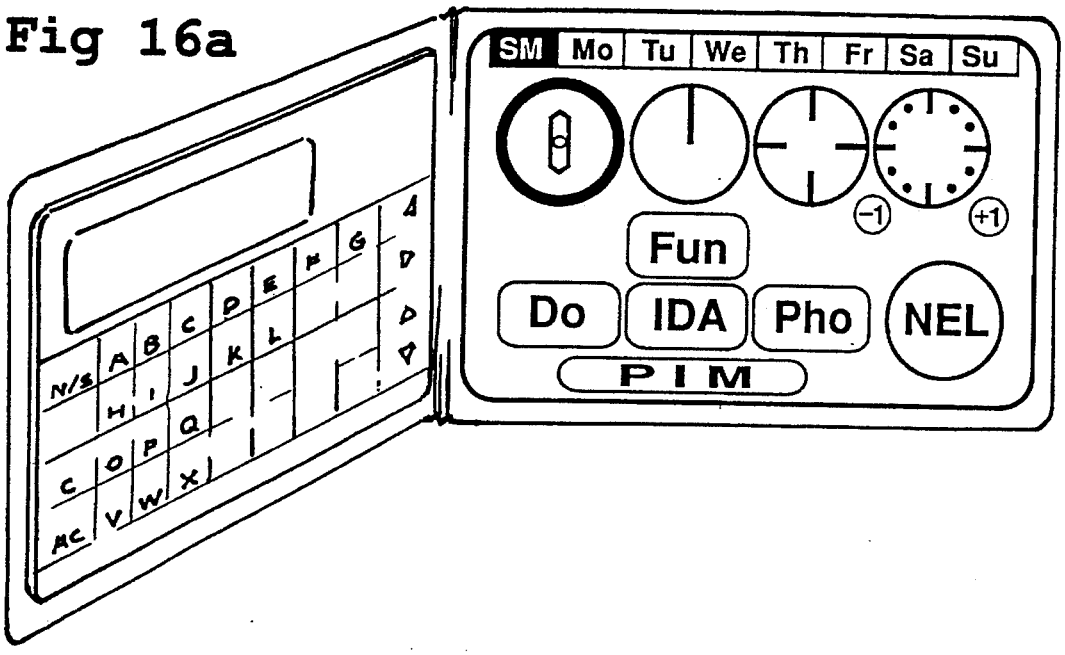
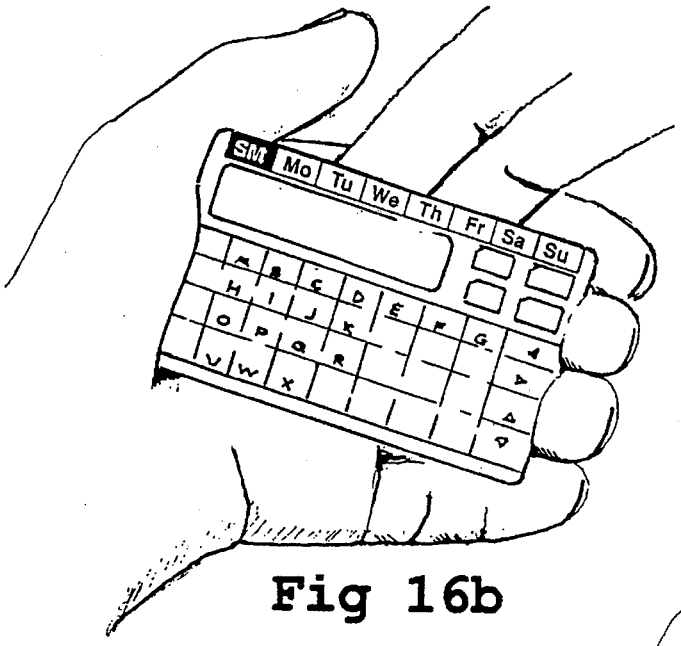
Fig 16b
Fig 16c
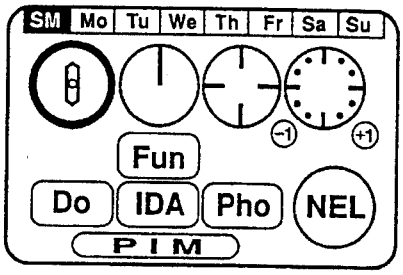
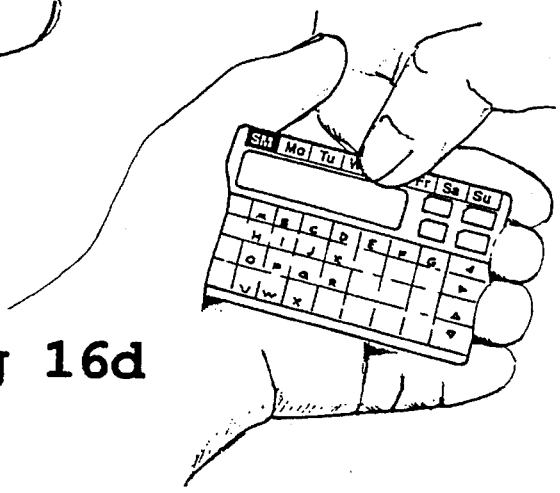
Fig 16d

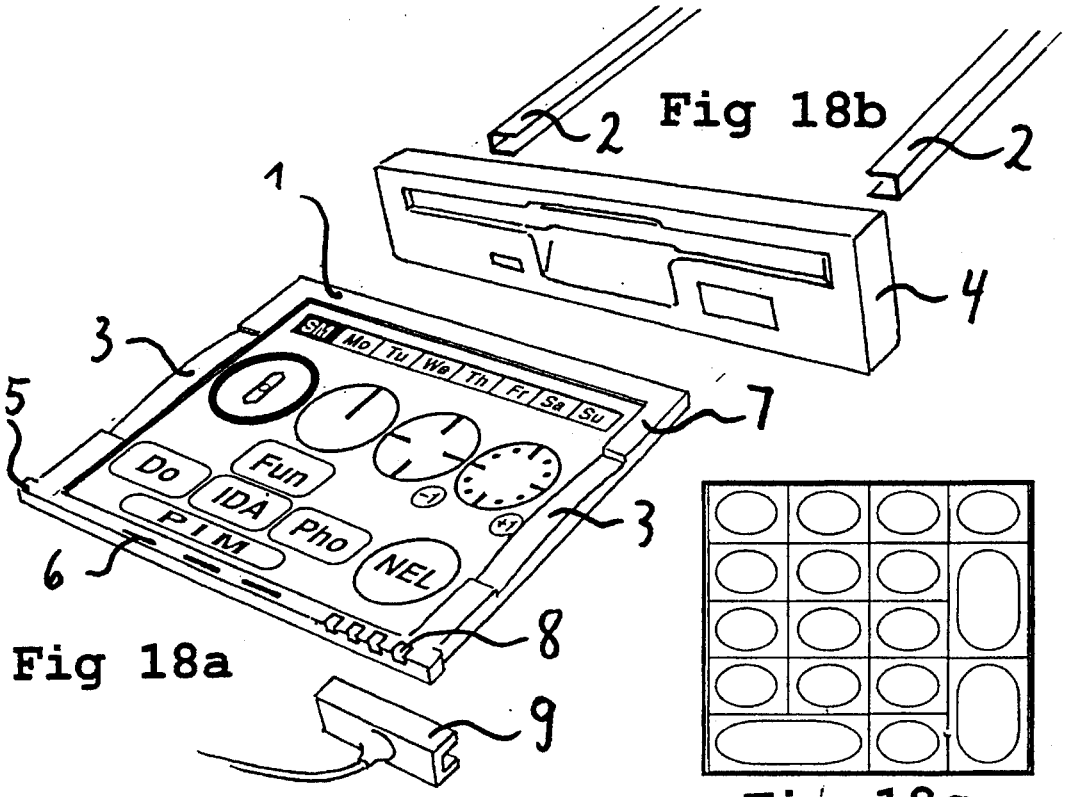
Fig 18a
Fig 18c
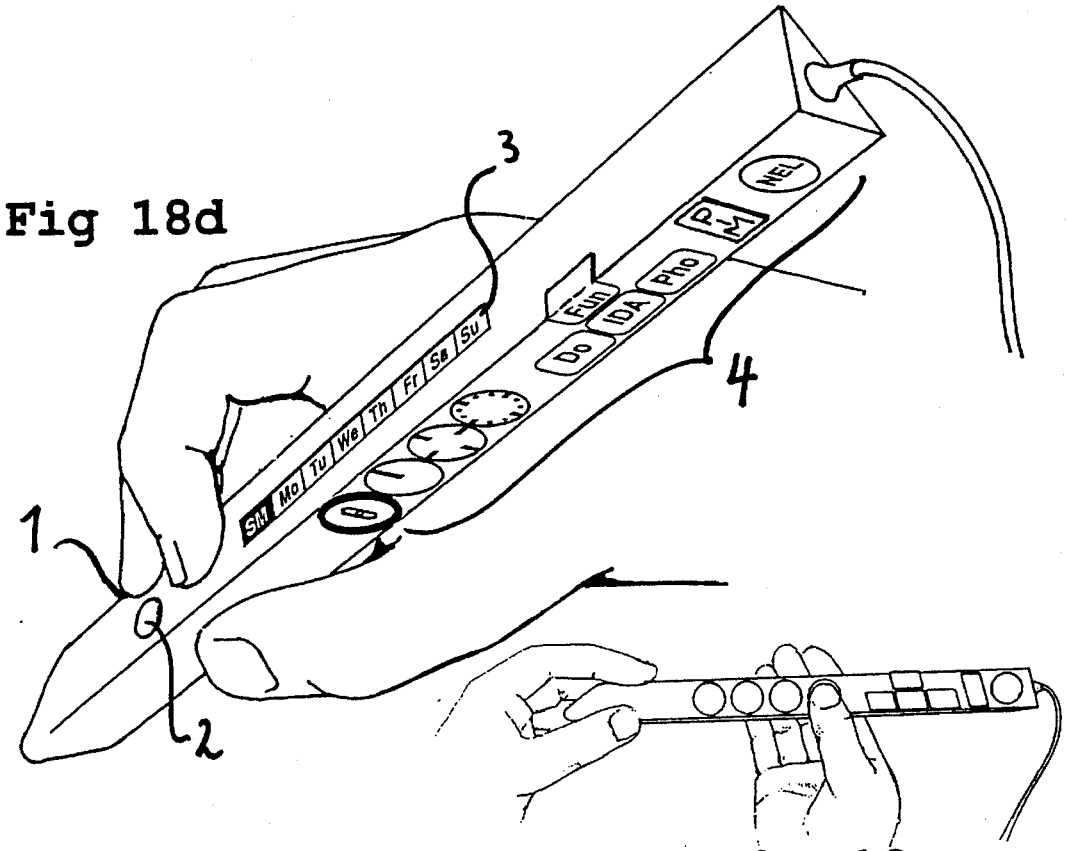
Fig 18e

CLOCK WITH TARGET TIME ENTRY SYSTEM

FIELD OF THE INVENTION

The present invention relates to a clock comprising at least one display means for indicating the actual time, at least one input unit for entering at least one settable, possibly date bearing target time which may be stored in a memory and at which, if reached, an event may be triggered, and at least one display means for indicating the target time(s).

The entry of specific times of future events in clock, watch or timer systems, which also signal the occurrence of such events by reminding or alarm signals or which, when the selected target times are reached, trigger technological programme functions, firstly regions a clearly readable operating means which is easy to handle, and secondly results in the wish to have a maximum number possible of options available for entering additional information identifying the target time or an event.

On account of the ever-increasing miniaturization in the fields of mechanical engineering, electronics and the great variety of potential modes of visually displaying information, it is easy to respond to the requirement mentioned last. However, here the problem arises that the operation of the numerous input means becomes complex and less clearly recognizable. Frequently the noting of reminder dates, the setting of some industrial controller or household appliance of any kind whatsoever, already requires extreme skills. The great number and variety of the systems is so enormous that many users are no longer willing to accept these difficulties, which often results in a total rejection on the users' part.

This rejection is not only due to the often very great visual and ergonometric problems in handling the great number of figures and in operation of the buttons which are frequently difficult to activate, but also to the fact that the input systems do not full consider our personal, natural, analog, dynamic experience of time.

Whenever a person takes the well-considered decision to do something at a specific time in the future that person has already arrived at that point of time in his or her imagination, specifically he or she skipped to that particular hour on that day, having already concrete ideas of his or her activities.

There is often the wish to define or describe this activity by a catchword and to have oneself reminded in an appropriate manner at the appropriate time. To arrive at this aim, however, a long way must be covered.

PRIOR ART

Three different, even though very common "target time setting methods" will be described for illustrating the problems in handling so-called timers, which are similar in many appliances of every-day use both in the private and the professional sector, as well as in data processing and mainly in the so-called time management programmes—no matter whether they are designed for individuals or for networks. For the sake of simplicity we are going to start out from today's date, Wednesday, October 7, 10:08 a.m., in a description of these three setting methods and in the statements set forth hereinbelow. We will try to set several appointments, starting out from that point of time, in particular, however, target times in the very next future (i.e. times within three hours from now at maximum), a target time in the evening, e.g. 20:30 or 8:30 p.m., respectively, as well as a few target times on days in the future, e.g. tomorrow, 10:30 a.m., by way of examples.

The first widely spread target time setting method is based on approaching the target in small increments by brief depression of buttons, first by a single increment at a time, then by keeping the button depressed so as to trigger a sequence of numbers, in order to aim at a fairly remote target. In this manner it is possible to take aim at a specific date, an hour and a minute. The problem now resides in the aspect that it is entirely unnatural to race toward the target first in the most minute steps, and then at an ever-increasing standardized, mostly breath-taking, speed by minute increments. The problem is common. Often the operator goes beyond the target and has to begin again at the starting point. Or the setting operation is stopped, for fear, too early so that further operations are necessary to try again to reach the aim.

If merely the minute must be adjusted, e.g. by forty minutes, we are confronted only with a single difficult task. The situation is different, however, if one has to adjust the date, the hour and also the minute, again very precisely, using this "small step/rush/race/stop" method. In such an approach the level of difficulty of the operation is principally similar for all points of time in the near and the more remote future. There are no "easier" full hours or other turning points—the future is treated like a non-qualified chain of small steps of time, and all points on that finely structured line are practically equally hard to hit.

Such a complex setting operation requires an optimum illumination, full concentration and a high degree of skill. But this has basically nothing to do with our activities actually scheduled for that target time.

What may additionally contribute to this difficulty in such an approach is the fact that particularly the starting point of our setting operation is not congruent with our actual time, neither by date nor by the hour or the minute. We are then bound to take sight at and reach our aim, starting out from an entirely different point of time, even though we have made our decision here and now. Even with a wrist watch equipped with a trailing timer clock, which always indicates the "present" time and which is available everywhere in the market, it is almost as difficult, despite the great comfort which the watch offers due to the actual time, because it is equally based on the principle of "small step/rush/race/stop". This corresponds precisely to the inversion of real life.

A second setting method, which, like the majority of alarm clocks, operates, inter alia, on the absurb principle of "backward travel through time", may be found in many video systems. If you want to enter a programme beginning tomorrow at 10:30 in the morning, today, on October 7, at 13:00 (1:00 p.m.), it is possible to push a button on these appliances for sequentially addressing the next few days with a forward orientation. By such a method, so to speak, one skips to the correct day with the incorrect time. First one has to orient oneself and then, in this simple example, one counts back from 13:00 (1:00 p.m.) down to the target time 10:30 which is in the future. By the first operation the time 10:00 is reached, then the operation is continued with the minutes to arrive at 10:30. if, however, our starting point (1:00 p.m.) is more complicated, e.g. 20:45 (8:45 p.m.) the problem is considerably more complex.

Experience has shown that the backward travel through such a long period of time with full concentration on the scrolled-through numbers is difficult to manage. If we think of tomorrow morning we skip in our imagination from now to then by a simple thought. The situation is different, however, if we are bound to fix our eyes on a target by upward or downward thinking, starting out from a wrong time, through +/–day, +/–hours, +/–minutes. Racing through a sequence of numbers in upward or downward direction, which numbers should actually mean a dynamic time in the future, ignores all exterior and interior sequences which have to do with an activity in the future and with reaching this aim. Since the problem of designing user-friendly video recorders could so far not be solved partly ingenious auxiliaries have been designed in order to establish a bridge over the gap between the broadcasting station and our video recorder. The VCR Plus equipment, which is being used by millions in the United States, for instance, our VPS system in its present version, the bar code programming or other systems are very good auxiliaries but do not offer any solution to this problem in the long run. With these auxiliaries being able only to display a small number of programmes from among the numerous stations, only mass programmes and a uniform culture are promoted rather than supporting the individual's choice among options. In the near future TV programmes from all over the world will be available to anybody and new, commonly understandable methods of selection, tuning and programming must also be developed so as to safeguard the manifold cultures and individual demands. One approach in this direction is equally the subject matter of the present invention.

A third method of programming target times, which should also be mentioned even though it is suitable for application within certain limits only, operates on the basis of numerical or alphanumerical keyboards such as those on palmtop, notebooks, laptops, computers in general, or also keyboards on equipment, machinery, etc. If it should be noted, for instance, today on October 7, that a tennis match has been arranged with Mr. Miller for tomorrow from 10:30 to 11:30 a.m., both hands must be used merely for the fourteen key strokes 08.10.92 10:30. The numbers or words (zero, eight, point, one, zero, point, nine, two, point, two, two blanks, one two, colon, three, zero) have nothing to do with our activity scheduled for tomorrow. The system is merely digital, date-oriented, and non-qualified. A quality—such as "as early as tomorrow morning, Thursday, 10:30—does not exist. The orientation by the date is normally a burden since we are used to think in seasons, months, weeks, and mainly days of the week, times of the day, hours, etc., by which we want to do something. Even in the case of date-orientated operations such as "invoices due for payment" the date is more or less shifted into the background shortly before the due date since the payment must be effected, as a matter of fact, the day after tomorrow or "as early as tomorrow" (which is the quality).

Here we have touched on some essential problems only, from which the demand for less complex solutions may be derived which better correspond to real life. With the known equipment the means for signalling by the time of the event, which is closely linked up with the entry of target times, is very often operated on acoustic signals which when emitted in a piercing form create an uncivilized and annoying impression in the environment. Mostly the alarm is signalled—in a form completely surprising the user—rather than drawing attention to the approach of an event in an adequate form.

BRIEF DESCRIPTION OF THE INVENTION

The present invention is based on the problem of defining a device in a manner matched with the natural, analog, dynamic sense of time, allows for a simple, rapid and precise storage of several near and remote times of events, both as isolated target time or multiple repetitive target times, using a few number of input means, which device is mainly usable also in a manner encompassing several systems, i.e. uniform for small-size and large-size clocks, industrial process control, computer programs, for vocational purposes, on the way and equally at home, and which may be adapted to the individual requirements of the young and the old in a flexible and modular manner, and which, based on the same inventive principle, equally facilitates the entry of additional supplementary information descriptive of the target times, provides for manifold and yet easily accessible possibilities of selection and representation, as well as announces the occurrence of certain events in many different civilized and individually modifiable ways, and which is finally suitable for integration into as many existing systems as possible.

One inventive solution to this problem is defined in claim 1. A great number of inventive improvements are provided in the dependent claims and in the descriptions of expedient embodiments.

In accordance with the present invention a clock is provided which comprises at least one display means for indicating the actual time, at least one input unit for entering at least one settable, possibly date-bearing target time which may be stored in a memory and at which, if reached, an event may be triggered, and at least one display means for indicating the target time(s), which is characterized by the facts that the input unit comprises at least three main input means whereof each main input means, starting out from the actual time or the target time set immediately before with this or with another one of the main input means, allows for skipping to a point of time in the future, relative to the time instantaneously indicated on the target time display means, which is an integer multiple or an integer fraction of an hour and/or an identified beginning of a target period matched with the natural sense of time adopted by culture, civilization and tradition.

First of all, the following points are defined as such beginnings of periods satisfying these criteria, which a skip is made to by the operation of a time input means:
the beginning(s) of the respectively next

| | | |
|---|---|---|
| * minute | | * day |
| * 5 minutes | | * days of the week (7D) |
| * quarter of an hour | | * week |
| * principle periods of the day | early morning 0:00<br>morning 6:00<br>afternoon 12:00<br>evening 6:00 p.m. | * month (12M)<br>* quarter of a year<br>* years (10Y) |

It may be that the target time input unit is provided with a great number of input means, at least, however, three means, which are characterized by the aspects that upon each operation of the said main input means a skip to a beginning of a target period is triggered which is the next future multiple of a divisor of 24 hours, upon each operation of the other main input means a skip to the beginning of a target period is triggered which is the next future multiple of an hour, upon each operation of the further input means a skip is triggered to the beginning of a target period which is the next multiple of a divisor of 60 minutes in the future.

The great number of possible main input means may now be combined in almost any optional manner, be it in pairs or in sensible principal groups, in such a way that they best correspond to man's natural sense of time, that they can be represented in a form easy to note, and that they are easy to operate, such that mainly some few basic elements of the first principle group may be used in a system-overlapping form also with symbols and relief configurations on clocks, watches, devices, keyboards as a uniform system. This first principle group, together with the respective operating buttons BT1 . . . BT6 for the beginnings of the target periods, is defined as follows:

| | |
|---|---|
| BT1 principal periods of the day | BT4 5 minutes |
| BT2 full hour | BT5 + 1 min |
| BT3 quarter of an hour | BT6 − 1 min |

Moreover, a clock is provided which comprises input means for storing detailed fact- or person-related activities together with the target times, and which comprises additional input means for pre-programming the approach and the occurrence of target times so as to make them adequately noticeable by the user by optical, acoustical or mechanical stimuli, employing appropriate means and in correspondence with the respective purpose, while further input means are provided which may be equally used in a modular form for industrial or private process control.

The inventive clock as well as any further aforementioned expedient embodiments are based on the fundamental idea of modifiable target skip systems which may be extended within a modular system.

The target skip system for the target time entry is oriented by the beginnings of periods which correspond to the sense of time that has evolved in the wake of civilization, culture and tradition.

These criteria only are relevant, independently of the respective cultural group or mathematical system constituting the actual origin of the periods corresponding to our sense of time.

For a better survey we combine all target time input means for each of the periods so far mentioned so as to form groups which seem to be sensible for the purpose of explanation, without considering the expediency of realizing such a great number of input means in some device, and leaving the question apart whether it would be better to restrict them in terms of number to a few only, depending on the purpose.

| | | | | | | |
|---|---|---|---|---|---|---|
| 4. target years (10Y) | 0 1 2 3 4 5 6 7 8 9 | | | | | |
| 3. target months (12M) | J F M A M J J A S O N D | | | | | |
| 2. target days of the week | S M Mo Tu We Th Fr Sa Su | | | | | |
| 1. target hours of the day | W D | BT1 | BT2 | BT3 | BT4 | BT5 |
| | | 0:00 | hour | quarter | 5 min | +1 min |
| | | 6:00 | | of an | | BT6 |
| | | 12:00 | | hour | | −1 min |
| | | 18:00 | | | | |

In group 1 (target hours of the day) the input means for weeks (W) and for the beginnings of the days (D) must be added while the second group (target days of the week) allows for skipping to the quarters (S) or the respectively next months (M).

For an explanation of some marked examples let us start out from the time mentioned above already, i.e. today, Wednesday, Oct. 7, 1992, 10:08 a.m.

TWO EXAMPLES

1st Example

1. Target time: today, 13:00 (1.00 p.m.). BT1 is used to skip directly to the beginning noon at 12:00. Then BT2 is used to skip to the hour beginning next, i.e. 13:00. The operation is finished.

Unless another key is operated within the next 3 seconds this target time is stored and is retained on the target time display. Unless a so-called "subsequent appointment" is entered within the next 3 seconds the clock returns to the initial situation, i.e. the actual time and the readiness for entry.

This example is to describe the most essential skip to a target, i.e. the first skip. If this operation were to begin some minutes or an hour later, rather than at 10:08 a.m., the steps would be precisely the same since the first target is not changed, even though the size of the skipped distance. These two steps—use BT1 to skip to 12:00 and use BT2 to skip to 13:00—are always the same, from 6:00 a.m. until 11:59 a.m.

The particular situations prevailing by this merely theoretical time of 11:59 as well as as the next two points of time, 12:00 and 12:01, are essential for the understanding of the target time skip system and of the idea underlying the present invention.

At 11:59 a.m.—i.e. one minute prior to the target point of BT1 (12:00)—all target skip distances of the input means "below" are identical. At this point their target points of time are diverging.

For BT2, BT3 and BT4 they are "residual skips" to the respective target points of time. For BT5 it is a full skip to a target time while for BT6 (−1 min), however, it is the target point of the first skip following the operation of BT1 to set the system to 12:00.

For the input means "W" (beginning of the next week) and "D" (beginning of the next day) they constitute nothing but movements within "their" periods.

At 12:00 the situation changes fundamentally. That point of time is not only the beginning of the target time period of BT1 (afternoon until 18:00) but it is also the point at which the beginnings of the periods of the input means "therebelow" converge. At this point all of "their" periods (60 min., 15 min., 15 min. and 1 min.) are, so to speak, nested within each other at the beginning of the period of BT1.

This situation is, however, located at a time which is not relevant for this aspect and which is associated with the periods "day" and "week" of the input means "W" and "D" "thereabove". Since the skip to 12:00 had been carried out with the aim to skip into a shorter period the status of "W" and "D" is neutral, which means that they are, so to speak, "non-existent"—unless the target would be suddenly changed at this point of time in order to skip to the beginning of the next day or the next week.

At 12:01 o'clock a fundamentally new situation prevails. With the exception of BT5 and BT6, all other 6 input means from "W" to BT4 are set to their characteristic "target skip status", which is essential of the invention, in order to return from the "personal" time again into the network of the social common orientation (possibly only transitorily). At that point of time the targets and skipping distances of all input means are abruptly different. Here the option is given to skip to 8 different target points of time of the input means, which may be each an intermediate point of time or at the same time the target point of time for an activity. With that the target skip system has been explained.

2nd Example

The target time is Friday, October 16, 10:00 a.m. The second group, the group of the target days of the week, is used to arrive, by "Mo", directly at Monday, October 12, 0:00, then "Fr" is activated to arrive directly at Friday, October 16, 0:00, then BT1 is used to skip to 6:00, BT2 is operated to set the time 7:00, 8:00, 9:00, 10:00. Then the operation is finished. The first skip by "Mo" to Monday, 12th, is valid not only for today, October 8, but also for a long period from Monday, October 5, 0:00 to Sunday, October 11, 23:59.

With this configuration the target skipping distance may vary over that period from one minute to practically one week. One essential inventive idea now resides in the aspect that a skip is carried out into the time orientation network, which has evolved by culture, civilization and tradition, from a "flowing", so to speak "personal" time "of one's own", which can never be precisely defined. This "cultural" network of orientation in time is composed of a great number of different groups of periods such as hours, days, weeks, months, which are differently dimensioned and may even vary within the individual groups. For instance, the numbers 3, 5 and 7 are relevant for a week, the 12 is important among the months, and the decimal system applies when counting the years. Even the months do not have all the same length, and the year has 365 days in the majority of cases.

From a mathematical point of view this is very complex and difficult to understand. In our imagination, however, we cope with this system without any problems. A skip over hours, days and weeks, even months, to years is not at all annoying us even though almost each skip over a month covers a different distance.

If we skip from these "major" periods such as months into a week, to a day of the week, to a specific target time, the inventive target skip system allows for a "landing" at the target with the same precision in terms of seconds as we achieve it in our imagination. What is important is the approach taken to skip to the intermediate target points and the actual aim, rather than the distance covered by this skip. The skip to the target is, so to speak, automatically precise in terms of seconds, without any specific concentration on the display, which is an intrinsic feature of the inventive target time skip system.

This target time skip system is supplemented by another target skip system relating to activities, facts and persons. The combination of the target times with activities etc. starts out from two basic observations.

On the one hand, there are many facts in common to the activities of young people of the same age group or people pursuing the same professions. The activities, obligations, interests and priorities, the acquaintances and friends as well as the rhythm of life of the individuals in a society are, however, so different from each other than a sensible raster cannot be found which would be equally satisfactory to all. For this reason the organizers are practically used only in business.

Despite these great individual distinctions, the individual experiences only minor changes among his or her friends, rhythm of live, principle interests, and the professional everyday routine is restricted to clearly visible main activities presenting basic patterns which are principally repeated with a high frequency. Therefore the same item is mostly painstakingly noted for another point of time in the "to do" lists of organizers.

The activity-related target skip system starts out from the idea that all repetitive activities, together with the names, spheres, names of places, etc. to be liked up therewith, may, so to speak, be filed in hierarchically structured lists and be easily fetched therefrom and composed, if necessary also supplemented. This target skip system is endowed with there principle spheres which may be individually structured and matched so that they may become interesting not only professionally but also outside the vocational activities, on the way and at home. These spheres are:

1. the "Do" sphere including principal and secondary activities,
2. the "phone" sphere
3. the important "Fun" sphere since, as a matter of fact, human beings are working and "fun" could be tolerated, also in business life.

The additional input means "IDA" (information differentiating the activity) could be used to supplement the main activities by names or product lists, to fetch identical activities on the display, to represent directions of use, to fetch various display configurations, etc.

In the case of timer clocks, which are not provided with alpha-numerical keyboards, the input means WRITE could be used to store the activities, names, telephone numbers, etc.

Repetitive appointments can be stored very rapidly in the course of the appointment entry operation. With a depression of the last target time input means for different periods of time it is possible to enter them immediately upon entry of that first appointment, e.g. 3 seconds for daily, 6 seconds for yearly, 9 seconds for repetition every month, etc. The symbols representing such repetitive appointments, e.g., RD, RW, RM, appear as suffix to the target time.

The "PIM" input means (=program intensity melody) is the last item in the information input line, which may be composed in a modular structure and which begins with the target time at which the repetitive appointments are noted; this line serves for entry of the main spheres "Do, Fun, Phone" and may be supplied by the IDA key.

Like all the other input elements, "PIM" is equally a separate small target skip system. It may be used to select the programs which are to be employed for target time presignalling, for defining the intensity, for indicating the intensity which optical, mechanical and acoustical presignalling alarms are operated with, while the "melody" category could also be used to produce acoustic sound impressions corresponding to the principal activities, e.g. "Happy Birthday" or similar melodies.

The analog representation of the appointment constitutes a definitely central inventive improvement which is mentioned as an expedient embodiment in several dependent claims and passages of the description. In addition to several digital displays an analog trailing date clock is provided in particular which indicates the approach of an appointment by a change of the face of the clock, and which is equipped with means by which the specific hour of the day (24 hours) can be recognized for which the target time is noted. This provision may also be used—in combination with an indication of the date—to display appointments far beyond the next day, as well as for a sequential display of series of appointments if a fetching means (NEL) is operated. A characteristic aspect of this trailing date clock is, however, the fact that firstly the appointments may be transferred from a digitally displayed series of appointments or from a memory for display in the vicinity of the main face of the clock. And secondly the inaction with a trailing minutes hand (MSZ) is equally important for taking adequate sight at a target time and bringing it stepwise into the main field of view, i.e. the analog face of the clock.

The trailing minutes hand (MSZ) plays the last and most important rôle within the general framework of the operation of taking aim at the target time, specifically be interaction with a digital display, mainly, however, with the aforedescribed main element of target time display of the trailing date clock to precede the target time hour.

That trailing minutes hand is disposed behind the minutes hand, receives the target time from the trailing date clock during the target time hour, displays the target time, and signals or rotates in the vicinity of the target time and other important signalling zones on the face in order to draw attention to the target time. The manner in which the signalling movements are carried out may also be an indication of main activities. Provisions are made for a great number of variations in the configuration of that hand, e.g. with a luminous tip, as luminous unit, or as hand of changing colours in the case of screen displays. Due to the fetching means "NEL" that trailing minutes hand, too, may, for instance, sequentially represent several target times noted during the target time hour.

A fetching, accelerating and eliminating means (NEL); =next elim) is provided which, configured as a multi-functional button, allows for the sequential fetch of target times and for an acceleration by a reduction of envisaged waiting periods. By depression for different lengths of time, NEL may be used to prepare the principal display for correction, to eliminate isolated or repetitive appointments, and by a simultaneous depression of a target day input means it is possible to eliminate complete series of appointments from highly different periods.

Another configuration in desk-top clocks is a month/day display panel in which also "identical activities" may be displayed at several points in a month.

Program-supplementing input means are provided as another expedient embodiment. The item "later" may be used to prepare an appointment for a shift to the future. The "back" input means may be used to effect a non-recurring backward skip in time by means of a target day input means. The DFP button (Do, Fun, Phone) allows, e.g. on a wrist watch, for drawing attention to the main activities by means of specific signals, the CTT means permits access to one or several trailing hands, while "hold" may be used to stop the return into the initial situation. NQH may be provided to define an individualized speed.

For controlling household appliances or industrial modular controllers of the most different kinds input means are also provided, for interaction with the target time skip system, which facilitate the program control, such as "PD" (program duration), "ST99" (for 99 broadcasting stations) or the like.

Several particular techniques should be mentioned as further embodiment within the general framework of a "cultivated" and acoustically not perceivable target time preparation. The multi-functional button "NEL" is provided as luminous element which is adapted to direct also light beams, e.g. onto the wrist of the hand. A special mechanism for wrist watches may be provided so that a setting arm, which when wound up may be read or palpated also as pointer, produces stimuli or irritations on the skin in the form of jerky movements in the case of a wrist watch.

A last embodiment mentioned here refers to a block or watch for elderly or blind persons, which provides for the verbal recording of pre-programmed sentences, together with the actual time, the target time and the countdown as the target time approaches or has been exceeded, with an initiation and termination by sounds.

BRIEF DESCRIPTION OF THE DRAWINGS

The present invention will be described in the following without any restriction of the general inventive idea, by the example of embodiments, with the drawings being referred to, which drawings, by the way, explicit reference is made in relation to the disclosure of all inventive aspects which are not explained in more details in the text. In the drawing:

FIGS. 8*a* through 8*g* illustrate a clock with stepped analog displays of appointments, FIG. 16*a* shows a mini-organizer with appointment entry, having the format of a credit card, FIG. 16*b* through FIG. 16*d* illustrates a mini-organizer with appointment entry means on the rear side, FIGS. 18*a* through 18*c* is a view of a double keyboard having the size of a 3.5" diskette, FIGS. 18*d* through 18*e* show a peri-mouse with appointment entry keyboard.

DESCRIPTION OF VARIOUS EMBODIMENTS

Figure 1:
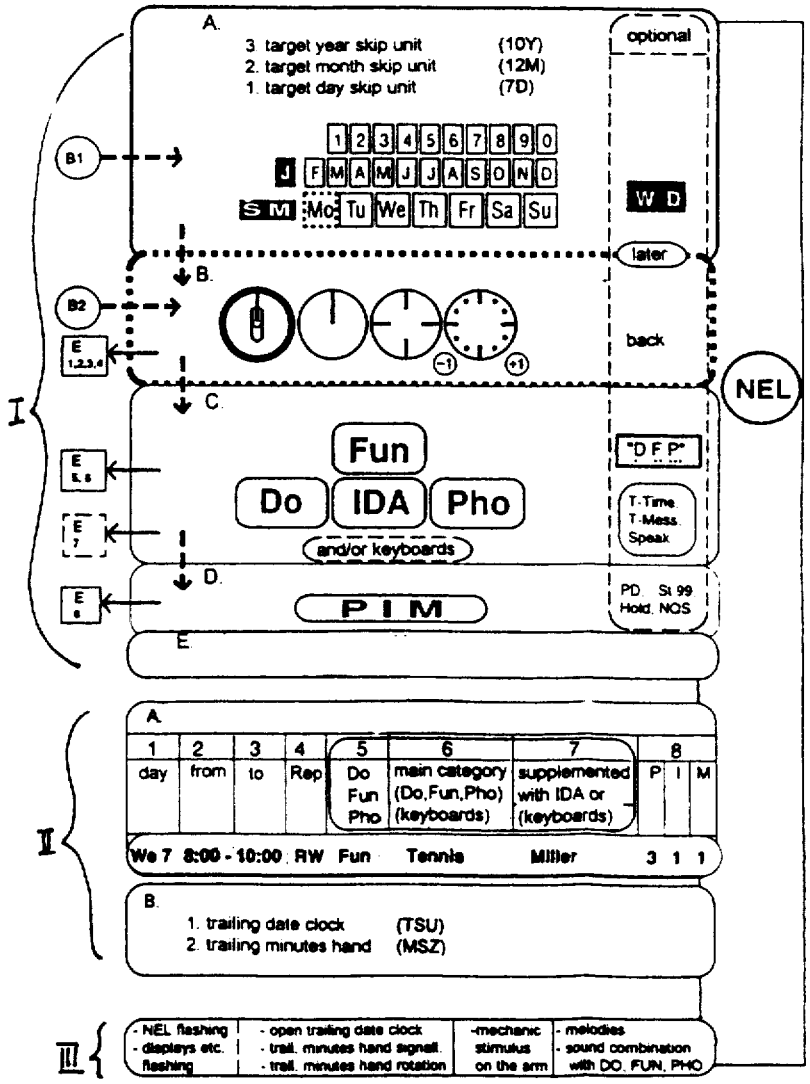
FIG. 1 illustrates a general diagram of the modular target skip system.

FIG. 1: General Diagram of the Modular Target Skip System

The system comprises the three principal elements i. target skip entry system ii. displays iii. pre-signalling alarms which are subdivided each in the most different manners. The system is composed of module categories which in their turn serve to create individual modules which on their part may be composed to generate information structured in the most different manners.

The system is oriented by targets, be it time targets in the future, target fields of activities or information targets, etc. The system is operated to aim at these targets—and this is the essential aspect—in a forward orientation, approaching the target in jumps as wide as possible, rather than rapidly in small steps, to skip to the beginnings of long periods, to panels of activities or information, and from there to the individual targets within a hierarchical structure, i.e. with different target skip distances.

Referring to FIG. 1, the system comprises: a modular target skip entry system I, displays (actual time display accepted) II, and displays (actual time display accepted) III. The modular target skip entry system I further comprises: a target days skip system A, a target point-of-time (of the day) skip unit B, an activity-identifying target skip system C, a programming target skip unit D, and an auxiliary wright means "WRITE" skip unit as well as PC and other keyboards E. The displays II comprise digitals, from eight module categories for manifold combinations A, and analog time displays B.

The top-priority objective to be reached by the invention is the entry, storage and representation of target times with the target skip technique, with additional information on the intention—i.e. the scheduled activity, the type of display, the mode of signalling—in a form as detailed as possible. To this end the aforementioned three main elements, target skip entry system, displays and pre-signalling means.

A second even though very important function is performed by the integrated target skip information system which supports the application of the first system in many ways. However, this aspect will be briefly discussed in the following.

In the course of its operation the system may be in very different phases, e.g. when target times are entered, when the operator has to wait for the subsequent flashing, when the various composed modules are stored with or without acceleration, or when information is fetched, combined or explained on certain periods or fields of activities. Fundamentally, three principal system states can be worded for a general representation:

1. The entry-awaiting status, i.e. the permanent operative state for entry of new target times without preparation. At the same time this state is a "state of passive information" in which the actual time as well as the first and possibly further target times are displayed with the requested configurations.

2. The target skip entry status, i.e. the status of all activities together with which a target time and possibly further modulus categories are entered, fetched and stored.

3. The active information status, i.e. the state in which specific information is temporarily fetched by means of input or fetching means.

The input status (cf. FIG. 2) starts with the operation of a time skip unit. This unit is illustrated in FIG. 1 and identified as "A. Target Day Skip System", which comprises the sub-units (10Y), (12M), (7D) target year, target month, target day skip unit, as well as "B. Target point-of-time (of the day) skip unit" (7D).

If, starting out from today, Wednesday, October 7, our target is Friday, October 16, 10:00 a.m., the Friday button would be operated twice on the target day skip unit (TTU) to skip to Friday, October 16, 0:00, from there, using BT1, to 6:00 a.m., and to skip to 10:00 a.m. by operating BT2 four times.

If, however, a target time for the current day should be entered one would start at B2 (cf. FIG. 1), i.e. the target point-of-time of the day skip unit (TTU) an then operate the buttons BT1 and BT2 to skip from the actual time (10:08) to the desired target time, e.g. 20:00 (8.00 p.m.). If an activity is to be pursued until 22:00 (10.00 p.m.) it is immediately possible to operate briefly the "NEL" button subsequently to define this period—calculated from 20:00—by operating the target skip unit BT2 for skipping to 21:00 and from there to 22:00. If the button BT2 is held depressed after the last skip, e.g. for six seconds, this appointment is stored as "weekly appointment" (RW) (cf. ii, displays, digital 8-module line).

Now the modules 1 to 4 have been defined in the displays whilst the locations for the modules 5, 6, 7, 8 in the display are occupied by a question mark flashing for three seconds so as to prompt a further entry. If there is no response to this prompt the entry operation is terminated (E 1, 2, 3, 4). The modules 5, 6, 7 and 8 may be handled on the basis of the same pattern, each entirely separate of the others.

If one of the buttons for the activity identifiers "Do", "Fun" or "Phone" are operated within the three waiting units this word appears under module 5 and now the "Fun" button may be operated, for instance, to fetch the activity "tennis" while friend "Miller" is fetched for module 7 through the "IDA" function. As has been mentioned already, the operation could have been interrupted already after module 5 or 6 (cf. E5, 6) whilst when the "IDA" function is used the operation may be terminated with E7—or a specific pre-signalling program is programmed via "D. Programming target skip unit" "PIM", possibly with a programmed intensity and an accompanying melody, whereupon the operation is terminated with E8. This termination is realized automatically unless a further entry is input.

Theoretically any number of individual variations can be combined from the various module categories, in particular from among the unlimited options provided in the "Do", "Fun", "Phone" and "IDA" memories.

The detailed descriptions of the activities which are stored by "Do", "Fun", "Phone" or "IDA", are entered via "E. Auxiliary write means". What is mentioned in FIG. 1 is the target skip unit "WRITE" (cf. FIG. 11*b*) as well as a PC and other keyboards. What is meant by these items is the fact that when the modular target skip system is connected to a computer or integrated into a palmtop, a telephone or other equipment also other keyboards may be available as auxiliary write means.

Another important variant of the description of activities is provided for computer programs: if, for instance, an activity is opened in module category 5 with "Do, Fun or Phone" the module location 6 and/or 7 may be filled in through the computer keyboard while also a supplementary line may be written underneath the appointment line while at the same time an "information notebook" is opened for immediately recording items such as topics of a discussion, ideas or instructions.

Here the trailing date clock and the trailing minutes hand, which are illustrated in part B "Analog Appointment Display" in FIG. 1, will not be discussed, despite their importance. Item "III. Optical, mechanical, acoustical pre-signalling", which is reflected in FIG. 1 only as a general survey, will equally be discussed in another passage.

The "NEL" unit (illustrated here as a dominant element) may play a central rôle in any system state, which is roughly mentioned here in brief only since the "NEL" function may produce effects on all input systems, memories, displays and pre-signalling alarms. The "NEXT" function (short activation) may be used to fetch the next appointments into the principal display, to shift over to the next steps in the program, i.e. to accelerate the operation, to prepare the 8-module line for a modification, to produce a cursor effect for confirmation of the individual modules, to stop a pre-signalling program and to shift over to the next step. The "ELIM" function (activated by depression for periods of different lengths) may be used to erase words, appointments, repetitive appointments, either individually or in combination with a key of the target day skip system for complete periods, and for many other functions.

The buttons or input means mentioned in the "optional" field defined by interrupted lines have been enlisted there for the sake of completeness, with reference being made to the potential optional use in a horizontal combination; they are not discussed here, however, in further details.

The information system is equally mentioned here roughly without a further discussion of computer programs of the module target skip system. The "active information status" may, for instance, be established by skipping to a specific year, month and then a day.

In response the appointments on the target day are displayed. The display screen may then be held for an optional period of time by depression of the respective day key. Following the release of the key the system returns again into the initial state within three units of waiting time, i.e. into the immediate availability state and the actual time.

It could also be possible, however, to jump to the respectively next appointments even prior to the expiration of the three units of waiting time, by operation of the "NEL" key, to return then and to use a month or day key for skipping major steps. Another information means is constituted by the "IDA" key with the "identical activity?" function in the information status. If the main display is set, for instance, to "Fun tennis" in category 6 all scheduled tennis hours are fetched into the display, together with the appointments, the partners and the mode of pre-signalling, provided there is sufficient space.

At any point of a chain of information, which may be rather long and which is invoked by alternation of the target time-of-the-day skip system, the "NEL" or the "IDA" unit, the system may instantaneously shift over from the information status into the input status when a key on the "target time skip unit" (TTU) is operated. From that instant the input status is established. Now the time is counted for this day from 0:00 onwards while the target is entered by operation of the input means BT1 to BT6. In this manner it is possible, for instance, to interpose another appointment between appointments already entered on a certain day in the future, and to describe the interposed target by operation of the target skip input systems C, D or E. Such interference with entries already made could also be achieved by operation of the "NEL" key, either by release of the main display for modification (depression of "NEL" for at least one second, however for a period shorter than three seconds) or by the erase function for a selected appointment or a series of appointments, as described above.

FIG. 2 shows a plain embodiment of a timer clock, e.g., configured in the form of a wall-mounting clock, a desk-top clock, etc., which comprises the following main elements:

1. a clock indicating the actual time,
2. a digital display for indication of the target time (10:20 a.m.),
3. a target time-of-the-day skip unit (TTU), the central element for all target time entries, which consists of the following main input means:

BT1 (skip to the beginnings of the periods of the day (6:00, 12:00, 18:00, 0:00)

BT2 (skip to the respectively next beginning of an hour)

BT3 (skip to the next beginnings of a quarter of an hour)

BT4 (skip to the next beginnings of 5-minutes intervals)

BT 5 ±BT6 (plus/minus 1 full minute)
4. "NEL" flashing unit (next . . . next . . . elim)
5. "W D" unit for skipping to the respectively next beginning of a week W(Mo 0:00) or the next beginning of a day D(0:00)
6. display of the day of the week and the date.

Even though the principle of entry has been explained already in another passage the procedure should be illustrated here briefly with references to an embodiment of the clock.

The digital display indicates the target time 10:20. Since this clock, like all other clocks, is permanently in the entry-awaiting status this target time of 10:20 could be entered by operation of the two keys BT3 and BT4.

Shortly prior to the occurrence of the target time the "NEL" flashing unit begins to produce light signals and an acoustic alarm, for instance, is then triggered at 10:20, unless the operation is interrupted by a slight touch of the "NEL" button; the alarm could also be interrupted by touching the "NEL" button.

Further target times, e.g. 13:00, are reached by operating the time-of-the-day button BT1 for a skip to 12:00 and from there to 13:00. The day of tomorrow could be reached in the most different ways. Either by skipping to the beginnings of the periods of the day (12:00, 18:00, 0:00) or by directly skipping to the target by depression of the "D" key for jumping to the beginning of the respectively next day.

If the stored target times are to be called onto the main display the "NEL" (next) function is activated which may be briefly operated to "thumb through" the target times. It goes without saying that here and in all other clocks the date display is linked up with target times which are farther remote in the future so that even very remote targets can be unambiguously indicated.

Figure 2A:
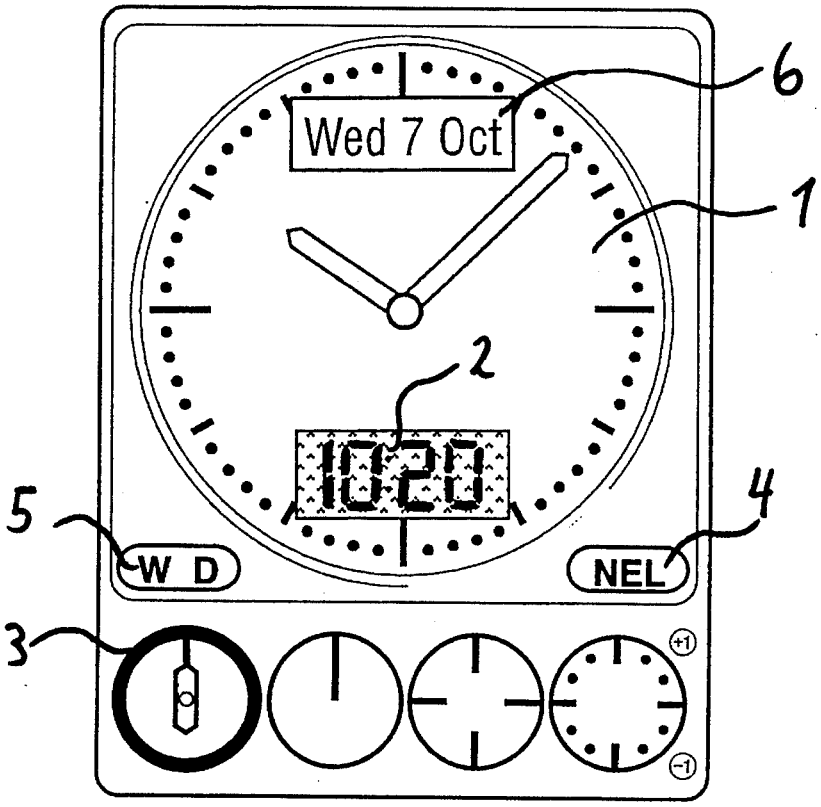
FIG. 2*a* shows the basic target timer clock.
Figure 2B:
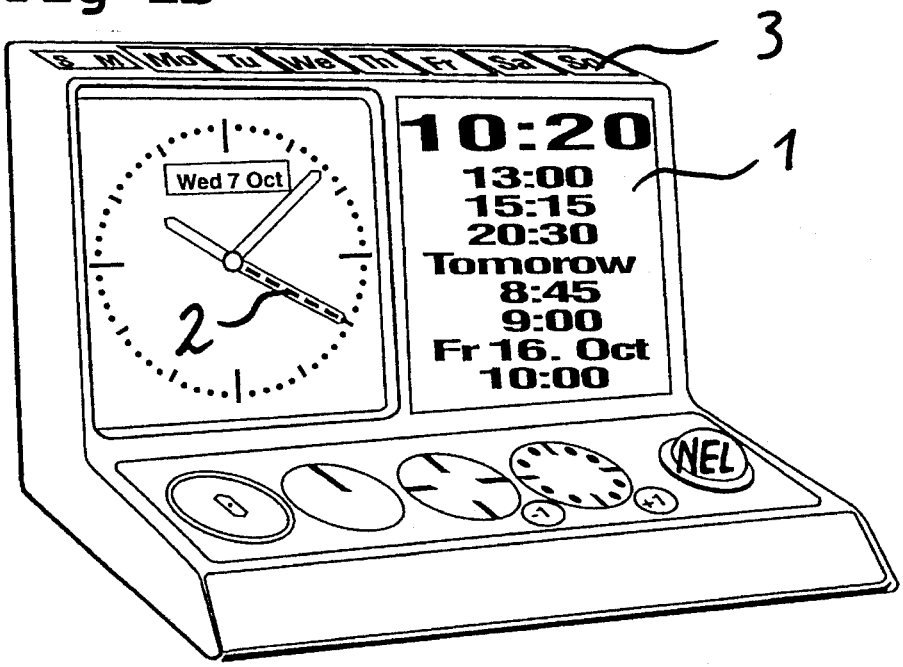
FIG. 2*b* is a view of a desk-top clock with a trailing hand and a target day skip unit TDU.

Compared against the basic clock illustrated in FIG. 2*a*, FIG. 2*b* presents mainly three essential other elements which entail particular advantages for target time entry, call, display and the optical alarm for signalling the target time:

1. a digital large-size panel for displaying several target times together with the date (day of the week, days in a month, etc.),
2. trailing minutes hand (MSZ) which signals the pending appointment (10:20) in the scheduled hour by its colour design in a conspicuous, precise and mainly easily readable manner, 3. the target day skip unit (7D) including the elements "S M" (for skipping to the seasons and the months), "Mo, Tu, We, Th, Fr, Sa, Su" (for skipping directly to days of the week).

When the respective key is operated the appointments scheduled for the day to which a skip has been carried out appear on the display, together with the subsequent appointments, if there is enough space left on the display.

By contrast to FIG. 1, here several stored target times can be displayed. Such a digital target time representation is, however, entirely undynamic. The eye is, as a matter of fact, mostly fixed on the principal clock. Therefore, the most important element of this clock, the trailing minutes hand, appears from behind the minutes hand in the hour relevant for the target time; this trailing hand receives the target time from the digital display and has such a conspicuous design that it points to the target time 10:20 in a distinct form. In other words, as long as a trailing appointment hand does not appear in the face of the clock new dates are not pending.

It is not necessary here to explain how rapidly one can reach any date of the year for information or entry of the target time by operation of the "target day skip unit".

Figure 3:
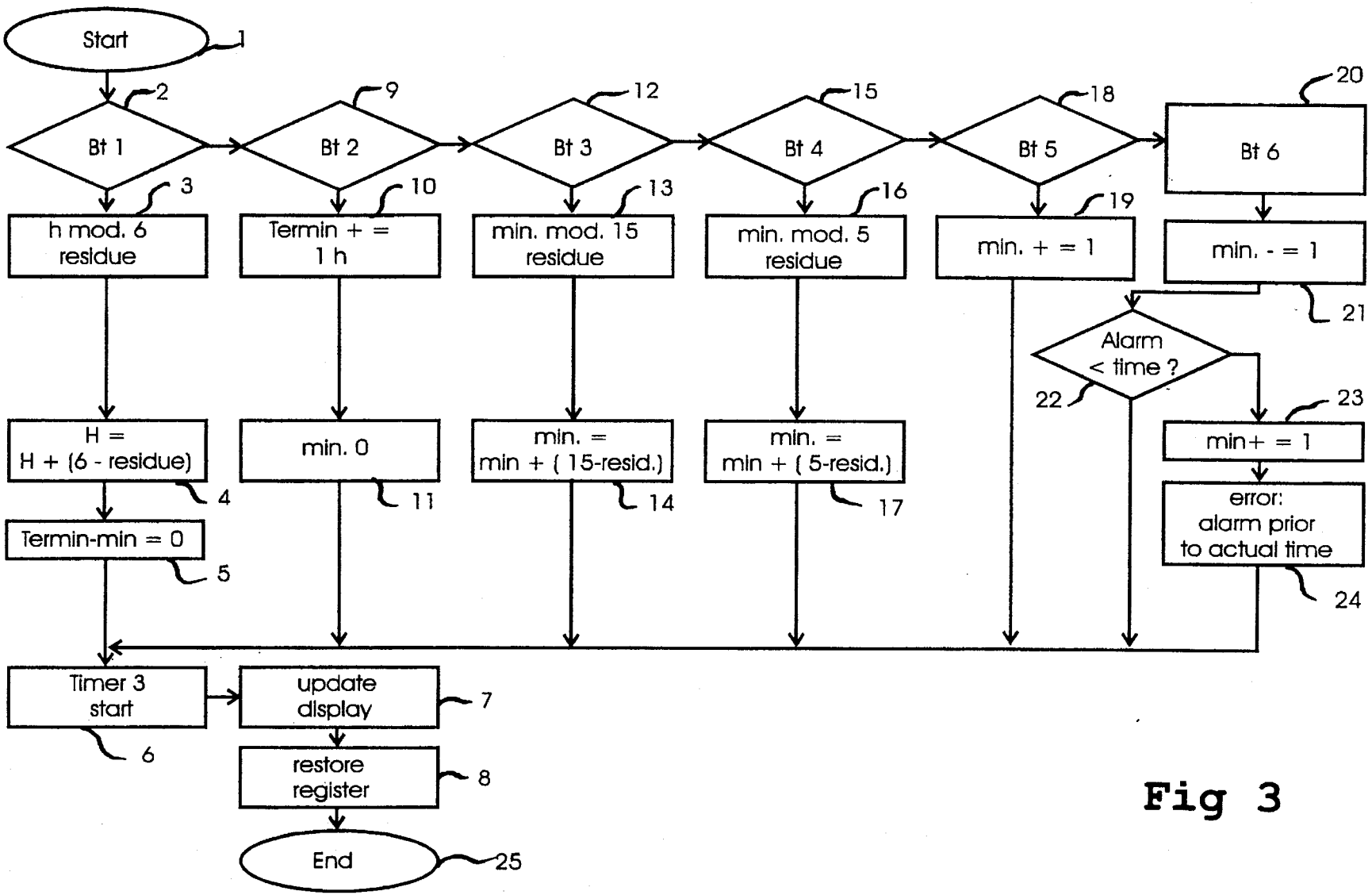
FIG. 3 is a flow chart of the target entry for the day, using the elements BT1 to BT6

In steps (2), (9), (12, (15), and (18) in FIG. 3 a branch is carried out to different program segments, depending on the respective keys BT1 to BT6 which have been depressed. (Step 26 is actually not an instruction since if the answer is "NO" to question 18 the BT6 key must be involved.

By way of example the program sequence will be described here for the case that the key BT1 has been operated. In step (3) first the remainder or residue of the division of the appointment hours by 6 is calculated.

When the hours of an appointment can be divided by 6 to obtain an integer (0, 6, 18) (step 9) 6 hours are added while in all other cases the residue is added and then the minutes of the appointment are set to 0 in step (5).

Similar functional sequences take place in the other program segments: in the case of BT2 the hour of the appointment is incremented by 1 (step 10) and the minutes are set to 0 in step (11), etc. The only exception is BT6 where an interrogation is made in step (22) to determine whether the subtraction of a minute executed in step (21) will not lead to a drop below the actual time. If this is the case a further minute is added in step (23).

Independently of the respective BT key which has been depressed the timer is started in step (6) which is associated with the transfer of the target time. The new value of the target time is then written into the main display in step (7). In step (8) the registers are then restored into the state they had by the time of the interrupt and in step (25) the interrupt handling is terminated.

Figure 4A:
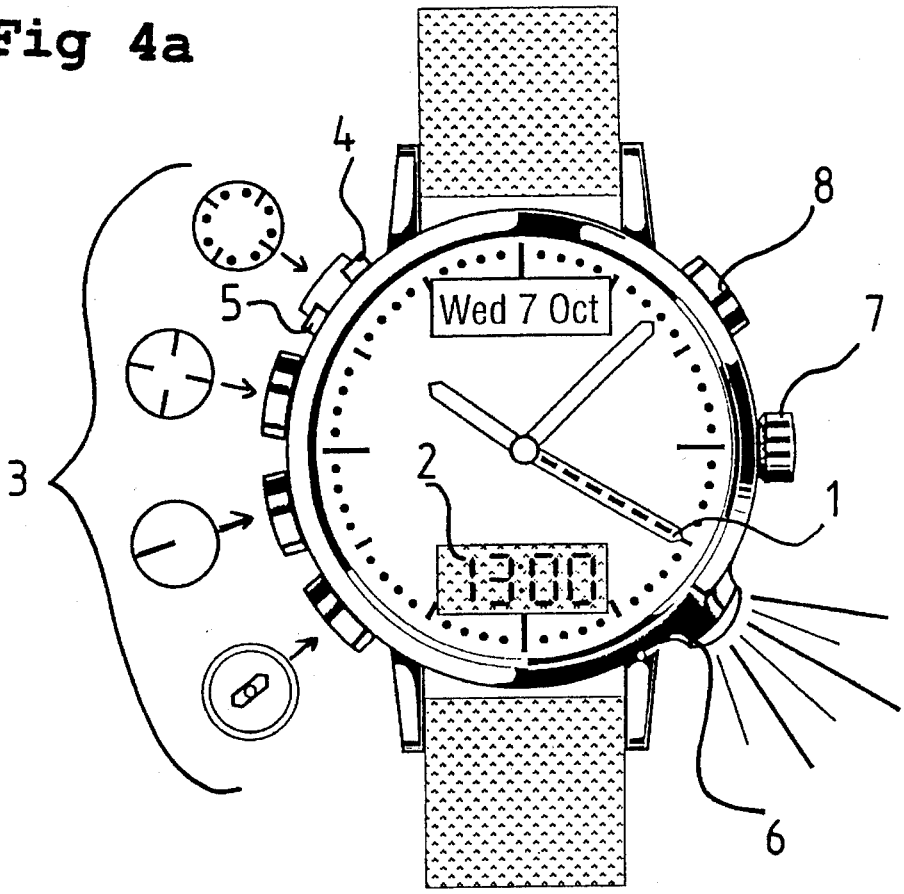
FIG. 4*a* shows a wrist watch with trailing date hand.

FIG. 4*a* shows a wrist watch having a structure fairly similar to the design of the desk-top clock according to FIG. 2, which means that it comprises an analog face, a date indicator, a trailing minutes hand (1) for indicating the target time within the current appointment hour as well as for drawing attention to the appointment by signalling and rotating briefly before the target time. Moreover, it comprises a digital display (2) to indicate further target times, the target time keyboard (3) with operating elements associated with the four principal periods of the day, and with the two elements for "+1 min" (4) and "−1 min" (5). The two buttons mentioned last are so designed that they can be clearly distinguished from the "5 min button", that they can be easily touched and operated by the finger nail. The element (D W) (8) may be used to skip to the beginnings of or appointments on individual days or to the beginnings of weeks. By pressing on the winding crown (7) (DFP key) once, twice or three times sounds may be generated which are associated with the main activities Do, Fun Phone so that the user's memory is aided in thinking of the scheduled activity. The "NEL" unit (6) for "thumbing through", modifying or erasing appointments is designed as a light-emitting element in accordance with the present invention.

In opposition to the majority of wrist watches available in the market, which indicate an appointment by a load and abrupt beeping sound, this wrist watch has been designed to draw the user's attention to a target time in several decent even though effective steps. A reminding program could be so structured that the multi-colour trailing date hand signals about the target time, then rotates, and that then the NEL light emitter emits flashes to the user's wrist. An acoustic alarm is given only if the user should not have become aware of the optical alarms.

Figure 4B:
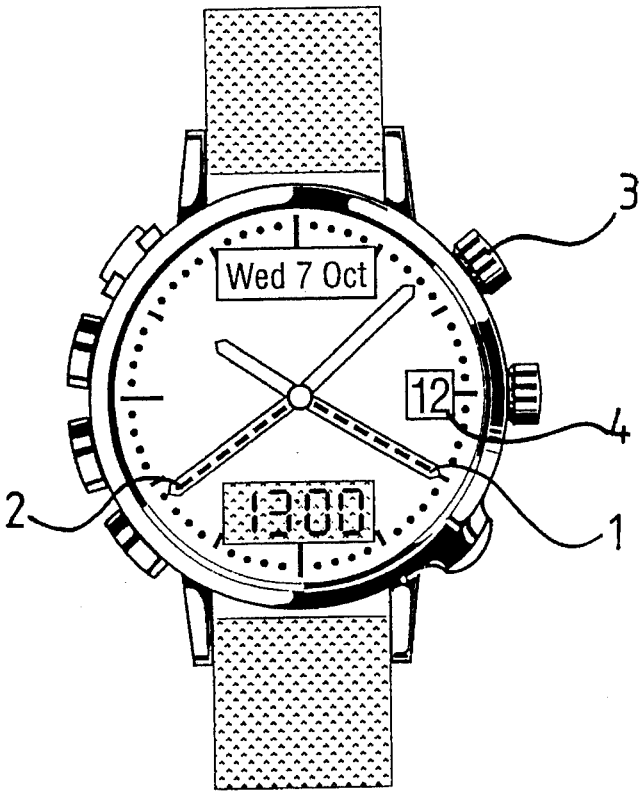
FIG. 4*b* is a view of a sportive wrist watch with two trailing date hands.

FIG. 4*b* shows a sportive wrist watch equipped in a similar manner as in FIG. 2*a*, however with the trailing minutes hand (MSZ1) for the first target time (1), the trailing minutes hand (MSZ2) for the second target time (2), a trailing hand access key (CTT) (3) as well as a count-down indicator (4) for indicating the residual time left from the actual time up to the target time. The two trailing hands may be set by operation of the target time keyboard like on the watch according to FIG. 4*a*. By depression and rotation of the key (CTT) access to the trailing minutes hand (MSZ1) may be made.

The trailing hand MSZ2 may be moved by withdrawing it and turning it forward or backward, as this is desirable for many kinds of sports.

The arrangement of the target time keys on wrist watches as illustrated in FIGS. 4*a* and 4*b*, including the four main keys for the principal target points of time of a day (BT1+BT6) and small keys (BT5+Bt6) for "+1 min" and "−1 min" allow not only for a rapid entry of a target time when the operator is sitting or walking in a normal way. If the watch is carried on the left wrist and held by the thumb and the ring finger of the right hand, it is very easy, even during an endurance run, to enter the target time with the index finger and the middle finger, without being forced to change the running rhythm.

The target time input keyboard (Bt1–Bt6) can hence be used not only on large-size clocks (desk-top clocks, wall-mounted clocks, etc.) but it is also suitable for wrist watches, thus being appropriate for a system-overlapping application in accordance with the objective of the invention as worded above.

What is more is the aspect that a new target time may be entered not only as the user is walking or making an endurance run but also, in an unnoticeable manner, amidst other people and when travelling. If the user has become accustomed to the target time input keyboard it is even possible to enter the target time in the dark since the skips to the target are not only extremely rapid but also precise to the second, and, as compared against the systems available in the market, they do not require any check or attention.

Figure 5A:
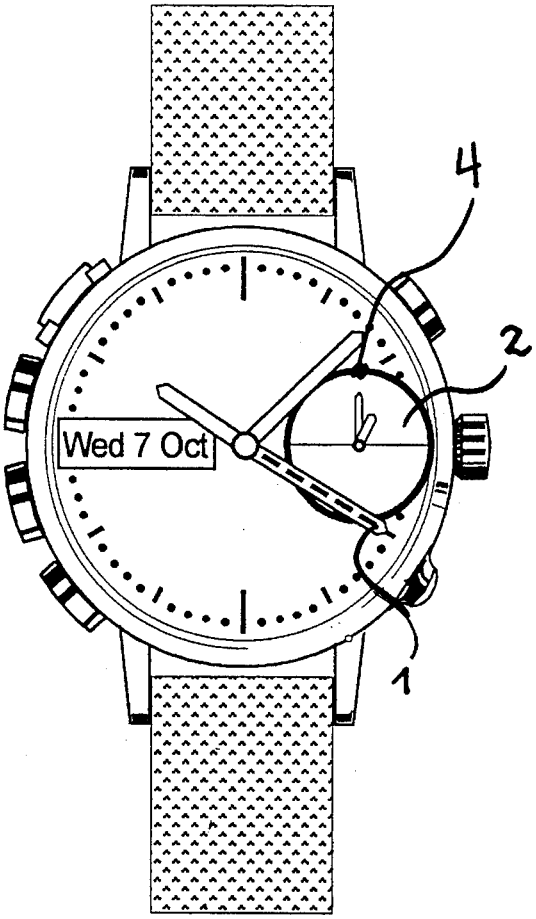
FIGS. 5*a* and *b* are views of a wrist watch with trailing date clock and trailing hand.
Figure 5B:
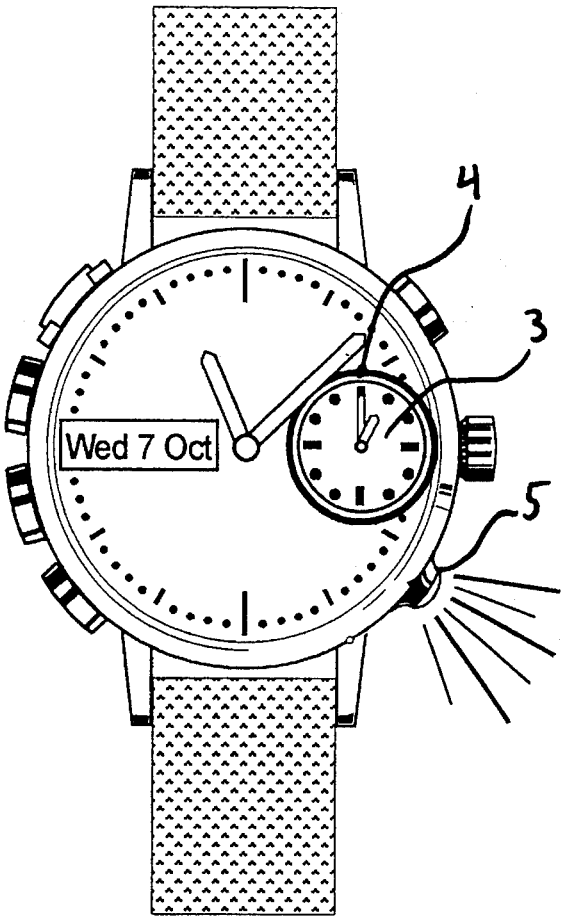
FIG. 5*c* is a view of a partly covered wrist watch with a luminous "NEL" unit.

FIGS. 5*a* and 5*b* illustrate a wrist watch indicating two different times, respectively. Instead of the digital date indicator, which is difficult to read, here an analog date indicator is provided in accordance with the invention, which presents the form of a trailing date clock having the following functions.

FIG. 5*a* indicates the first target time at 10:20 by the trailing minutes hand (MSZ) (1). A second target time at 13:00 is indicated by the trailing date clock (TSU) (2) in a very discrete manner since the trailing date clock is provided with a covering means (cf. FIG. 6). Depending on the program, e.g. two hours before the beginning of the target date—i.e. at 11:00 a.m.—the window opens (see FIG. 5*b*) to display the target time at 13:00 in a very clear form (3) as pre-signalling alarm for a target time still beyond the current hour. As this target time approaches, i.e. during the hour of the appointment, the trailing date hand, which presents a conspicuous design due to its colour, then adopts the new target time and indicates it for 13:00.

Figure 5C:
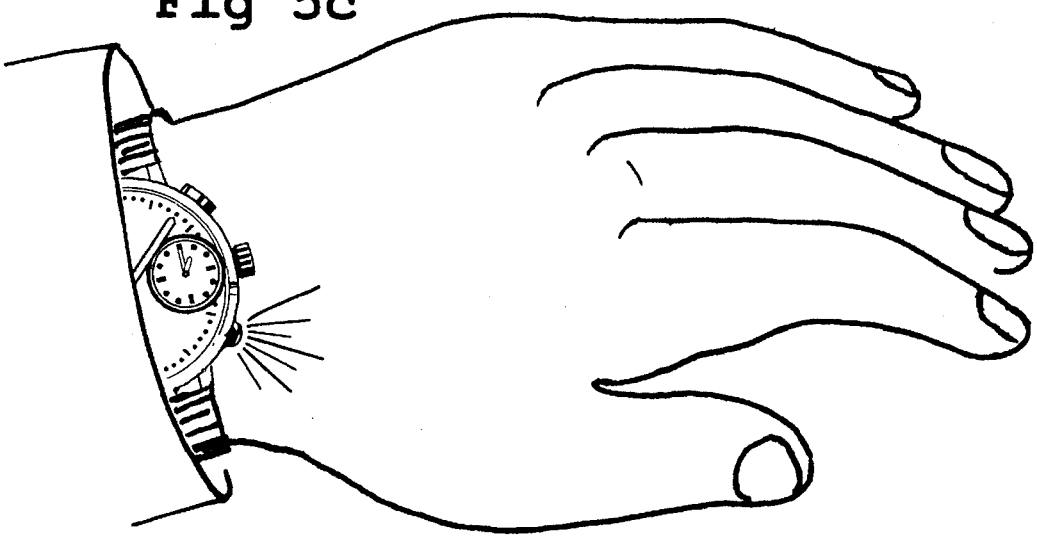
Figure 6A:
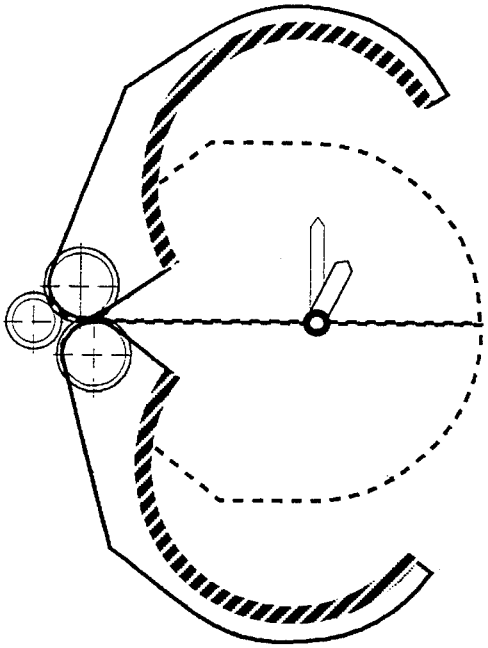
FIG. 6*a* illustrates a covering means for the trailing date clock.
Figure 6B:
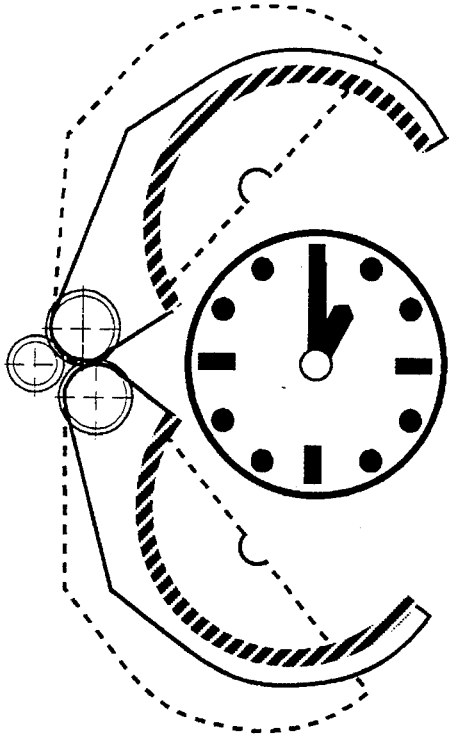
FIG. 6*b* illustrates a covering means for the trailing date clock.
Figure 6C:
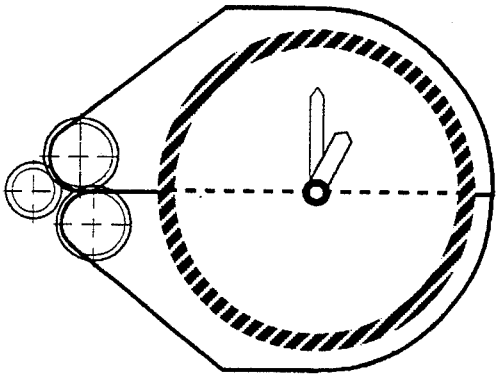
FIG. 6*c* illustrates a covering means for the trailing date clock.
Figure 6D:
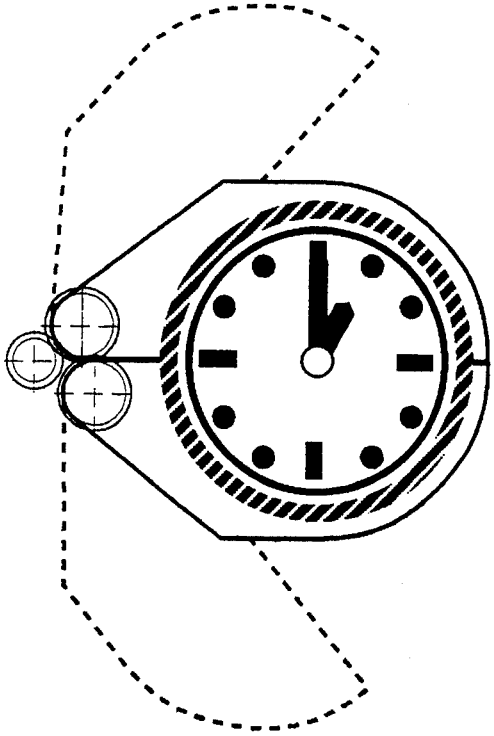
FIG. 6*d* illustrates a covering means for the trailing date clock.

In order to make it clear that the target time is 13:00 (1.00 p.m.) rather than the target time 1:00 in the early morning the trailing date clock is surrounded by a colour ring (4) from 12:00 onwards, which is produced by a second means (cf. FIG. 5*c*). If there is no further appointment the trailing date clock also indicates the target time 13:00 and from 13:00 onwards it advances in synchrony with the pair of hands indicating the minutes and hours. If, however, a further appointment has been entered for the same day the trailing date clock indicates it immediately as soon as the next target time has been adopted from the trailing minutes hand (at 13:00).

Using the technique outlined here, and in combination with the "NEL" key (5), which is designed here as a light emitter unit, it is possible to "thumb through" the target times, i.e. to display them by the trailing date clock, so as to perform a multi-stage optical alarm in a highly efficient manner, which may be supplemented by acoustical signals if necessary.

FIG. 5*c* shows a wrist watch in a very frequent position in which one half is covered. The signaling zone, which is important for the optical alarm, is the right half of the watch. Therefore all elements are visible in the signalling zone, which are used to this end. In accordance with the invention there the luminous "NEL" key is mounted in a way that it could also emit light flashes from under the sleeve; moreover, the trailing date clock with its conspicuous optical means for pre-signalling by a change of its face is provided at this location.

Finally, the signalling trailing minutes hand with its conspicuous design is so programmed that it indicates not only the target time but makes itself perceived also in the signalling zone.

Thus several mutually matched optical signals are conceivable on this wrist watch, which prepare the user for a target time and signal it at the given point of time, without any annoying acoustic indications being possibly perceived in the environment.

FIG. 6 shows two differing covering means for a trailing date clock. The first of them is suitable to cover the face of the clock FIG. 6*a* to indicate that the appointment is still remote. As this target time approaches, however, the range of two hours from the actual time the window opens FIG. 6*b* to indicate the target time by a conspicuously designed face. A ring (FIGS. 6*c* and 6*d*) with a colour design may be provided to indicate whether an appointment is "a.m." or "p.m.".

Figure 7:
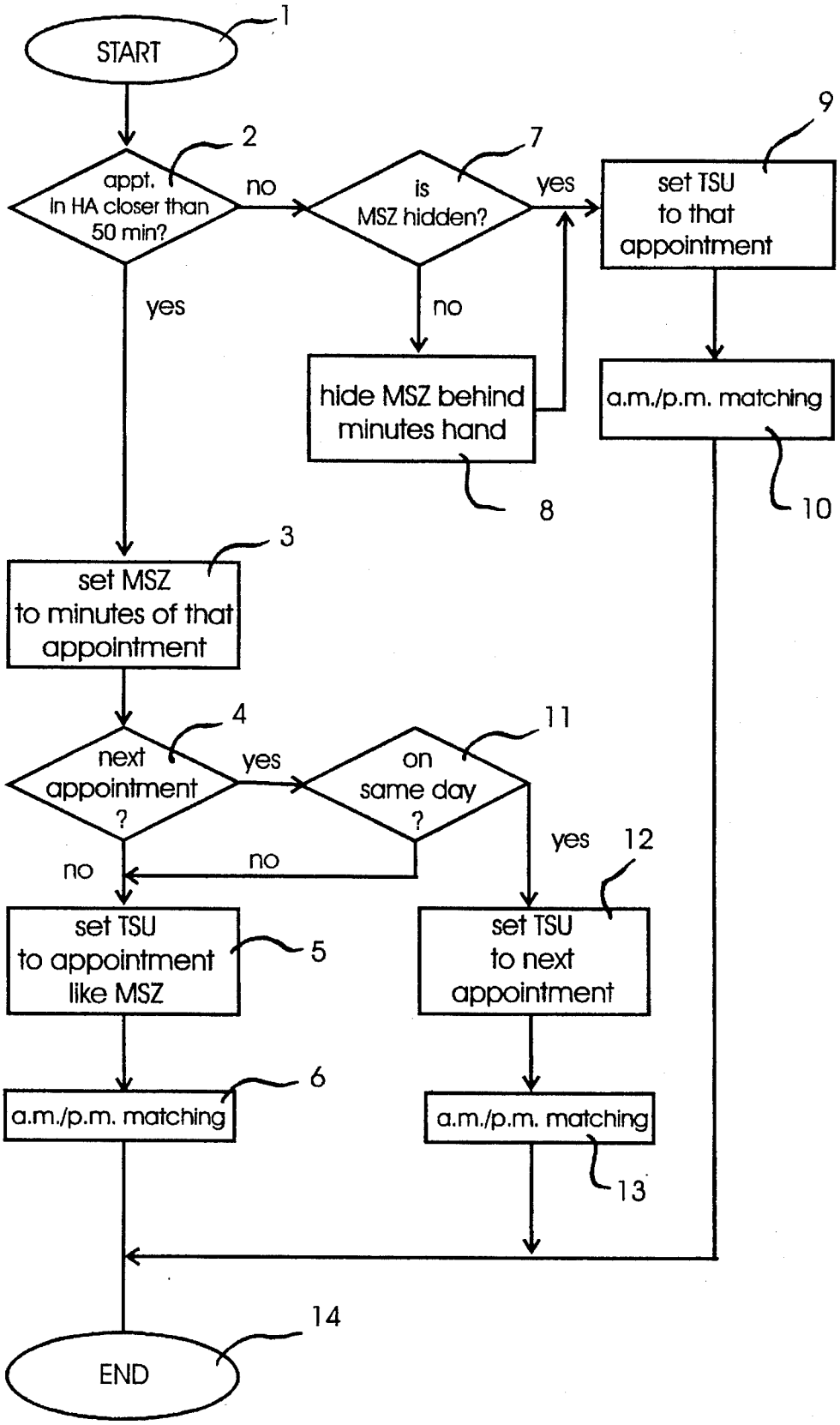
FIG. 7 is a flow chart of the operation of the trailing minutes hand and the trailing date clock.

FIG. 7 explains the control of the stepping motors for the trailing minutes hand and the trailing date clock. In that variant, however, the trailing minutes hand, which is normally hidden behind the minutes hand of the big analog clock or watch, is operative to indicate the first appointment while the trailing date clock is used for the indication of the second appointment. In this case it is assumed that the trailing date hand appears only when the appointment has approached already the range of 509 minutes from the actual time.

In step (2) an interrogation is made whether the appointment indicated in the main display is closer than 50 minutes from now. If the answer is YES the trailing minutes hand (MSZ) is set to the minute of the appointment in step (3). Step (4) is an interrogation to determine whether there is another appointment. If this is correct the procedure continues with the interrogation at step (11) whether this further appointment is scheduled for the same day; if this is correct the trailing date clock is set by subroutines to that next appointment in step (12), then the a.m./p.m. indicator is matched in step (13) and the procedure is terminated, which means that the trailing minutes hand (MSZ) is set to the first date while the trailing date clock (TSU) indicates, however, the next date on the same day. In step (12) as well as in steps (9) and (5) subroutines or secondary programs are started for controlling the stepping motors. If the answer to the interrogations (11) or (4) is "NO", i.e. if there is no further appointment on the same day, the trailing date clock is equally set to the single appointment on that day in step (5) by means of the appropriate subroutines. Thus the trailing minutes hand (MSZ) and the trailing date hand (TSU) indicate the same target time. In step (6) also the a.m./p.m. period is matched whereupon the procedure is terminated. If the interrogation (2) is negative another interrogation is made in step (7) to determine whether the trailing minutes hand is hidden behind the analog trailing hand of the clock. If this is not the case the hiding instruction is given in step (8) while the trailing date clock is set to the time indicated in the main display by subroutines in step (9). The a.m./p.m. matching is carried out in step (10) an the procedure is terminated (14).

FIG. 8 illustrates a clock having a trailing minutes hand and a trailing date clock at six different times for a general explanation of the step-wise preparation of the appointments.

Figure 8A:
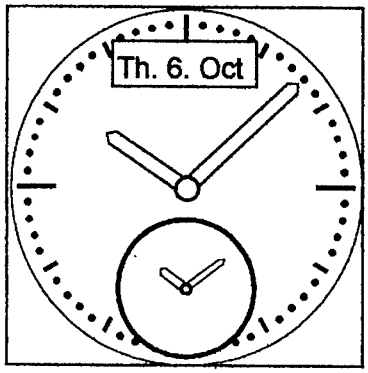

An approaching appointment is illustrated in various stages. In this case it is assumed that the first pre-signalling alarm occurs two hours ahead of the occurrence of the appointment via the trailing date clock, that the second pre-signalling alarm is given by the trailing minutes hand in the important hour of the actual appointment, with a further stage, e.g. two minutes ahead of the target time, in which the trailing minutes hand is signalling, etc. The combination of a trailing minutes hand and a trailing date clock allows not only for signalling in stages but also for the representation of two different appointments. For a distinction between an appointment in the first half of the day (a.m.) and an appointment in the second half of the day (p.m.) the face of the trailing date clock may be surrounded by a colour design ring to indicate "p.m." appointments. The face of the clock indicates the following potential appointments at the different hours:

FIG. 8*a* illustrates the clock on October 6. No appointment scheduled for that day. Therefore the face of the trailing clock presents the same colour as the face of the clock, due to the covering flaps (cf. FIG. 5*c*). The trailing date clock indicates the actual time, like the principal clock, in an inconspicuous manner.

Figure 8B:
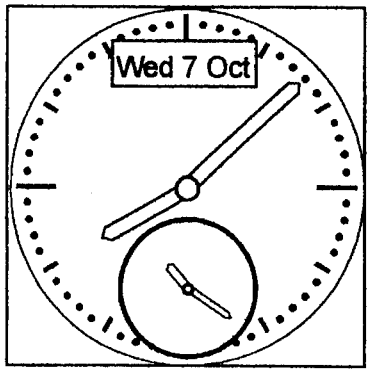
Figure 8B:
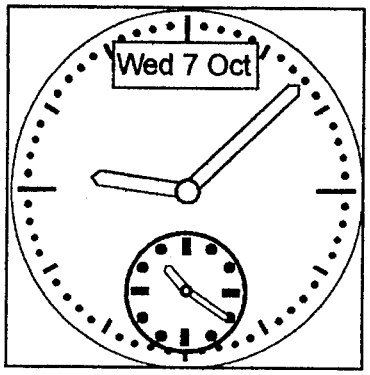
Figure 8B:
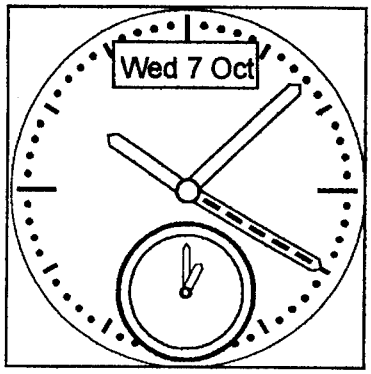
Figure 8B:
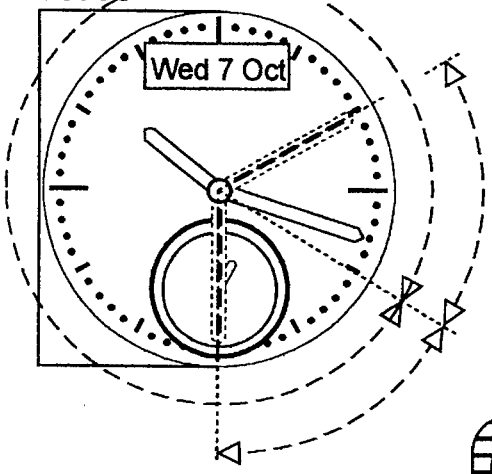
Figure 8B:
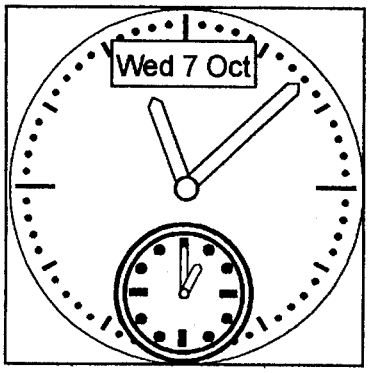

FIG. 8*b* On October 7, at 9:08. The trailing date clock inconspicuously indicates an appointment for 10:20. Two hours before the appointment, i.e.

FIG. 8*c* from 8:20 onwards, the trailing clock window opens and indicates the approaching appointment 10:20 by a distinct contrast.

FIG. 8*d* From 9:20 onwards the trailing minutes hand (MSZ) is uncoupled from the minutes hand so as to indicate the next approaching appointment for 10:20 in a highly conspicuous manner throughout the current hour of the appointment. The trailing date clock now indicates the second appointment in an inconspicuous manner for 13:00. The double ring signals that this appointment is in the second half of the day (cf. FIG. 5*c*).

FIG. 8*e* illustrates the clock at 10:18, i.e. two minutes before the set time of the appointment at 10:20. The trailing minutes hand carries out signalling movements (e.g. between 10:10, the target time 10:20 and 10:30) and rotating movements through 360° to draw attention to the pending appointment. It is possible to announce such an appointment in a civilized manner by additional optical signals such as flashing of the "NEL" key, flashing of the face of the clock, or a mechanical stimulus produced in the case of a wrist watch.

FIG. 8*f* illustrates the clock at 11:08 with the opened appointment window since the second appointment scheduled for 13:00 is already within the range of the next two hours.

Figure 8G:
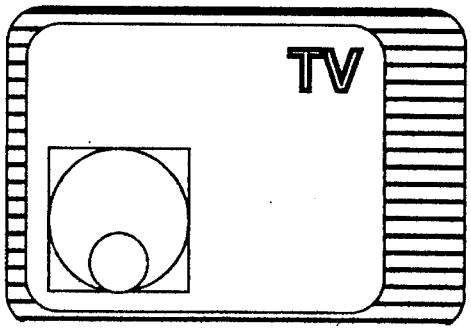

FIG. 8*g* roughly indicates one of the numerous possibilities of displaying the appointment with the same timer clock, e.g. on screens, since mainly in the case of colour screens it is not only possible to provide the trailing date clock with a clear colour design but also to increase the conspicuousness of the trailing minutes hand efficiently by flashing and signalling.

Instead of the signalling movement FIG. 8*e* above it is additionally possible to produce signals also at other important locations on the face of the clock. The clock with the 3 analog displays, which is described here, i.e. with the analog actual-time display and the two analog target time displays (i.e. the specifically designed trailing minutes hand (MSZ) and the trailing date clock (TSU) in the form described here) will be briefly referred to in the following by the term "triple analog display".

Figure 9:
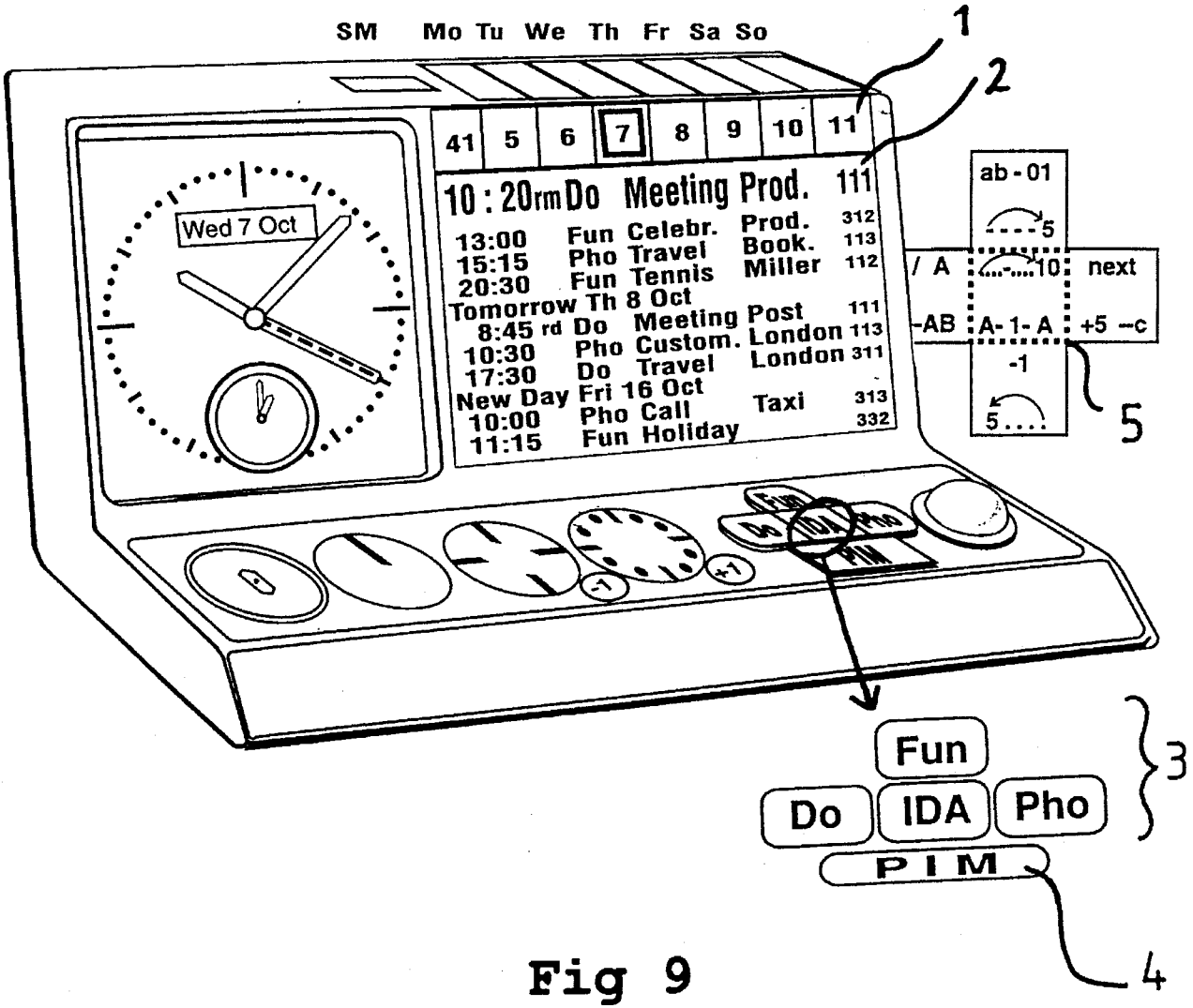
FIG. 9 is a view of a desk-top clock with descriptions of the appointments.

FIG. 9 illustrates a desk-top timer clock which comprises, in addition to the main elements already known, i.e.

triple analog display with date indicator
target day skip unit (7D)
the target time-of-the-day skip unit (TTU)

also the following five new elements:

1. the date of a complete week,
2. an appointment display having several lines and a multiple structure, in which in many different ways the appointment may be combined with or supplemented by modules within seconds—linked up with the date indicator of the principal clock (cf. also the explanations on FIG. 1 "General Diagram of the Modular Target Skip System").
3. The activity target skip system including three buttons to identify the principal spheres of activities (Do, Fun, Phone) which may be used to call the personal and individual activities. The number of these activities is optional, e.g. as few as three activities each for "Do, Fun and Phone" or a very great number of various activities, structured by principal and secondary activities. It is possible to call and display these activities rapidly as modules, operating on the target skipping technique (cf. FIG. 11*a*).

The "Do, Fun, Phone" activities may be further differentiated by means of the input means "IDA" (information for differentiating the activity). Structured name lists, product lists, names of places and towns, secondary activities, etc. may be stored in the "IDA" memory precisely in the manner required to meet individual needs and modes of being reminded of an appointment.

4. input means "PIM" (program intensity melody), the programming target skip unit for individualized setting of the mode of optical, acoustical and time-related presignalling of the target time, e.g.:

| PIM |
|---|
| 1 . . . . . open trailing date clock 3 hs. bef. appt. |
| 2 . . . . . open TSU 2 hs. before appointment |
| 1 . . . . . normal flashing and acoustic signals |
| 2 . . . . . optical signals only |
| 3 . . . . . intensifying/increasing acoust. sign. etc. |
| 0 . . . no sound if intensity set to 2 |
| 1 . . . normal 3 diff. sounds for Do, Fun, Phone |
| 2 . . . Happy Birthday melody or the like |

5. "WRITE", the auxiliary writing means as described in Annex XYZ. It is merely roughly outlined in the drawing. It is expediently mounted on the rear side or at the bottom of the clock.

Due to the specific equipment of this clock it is possible to enter near and also very remote appointments within seconds, to differentiate and represent them with the same high speed in many different ways, and to have oneself reminded of them by means of an individualized programming segment.

Figure 10:
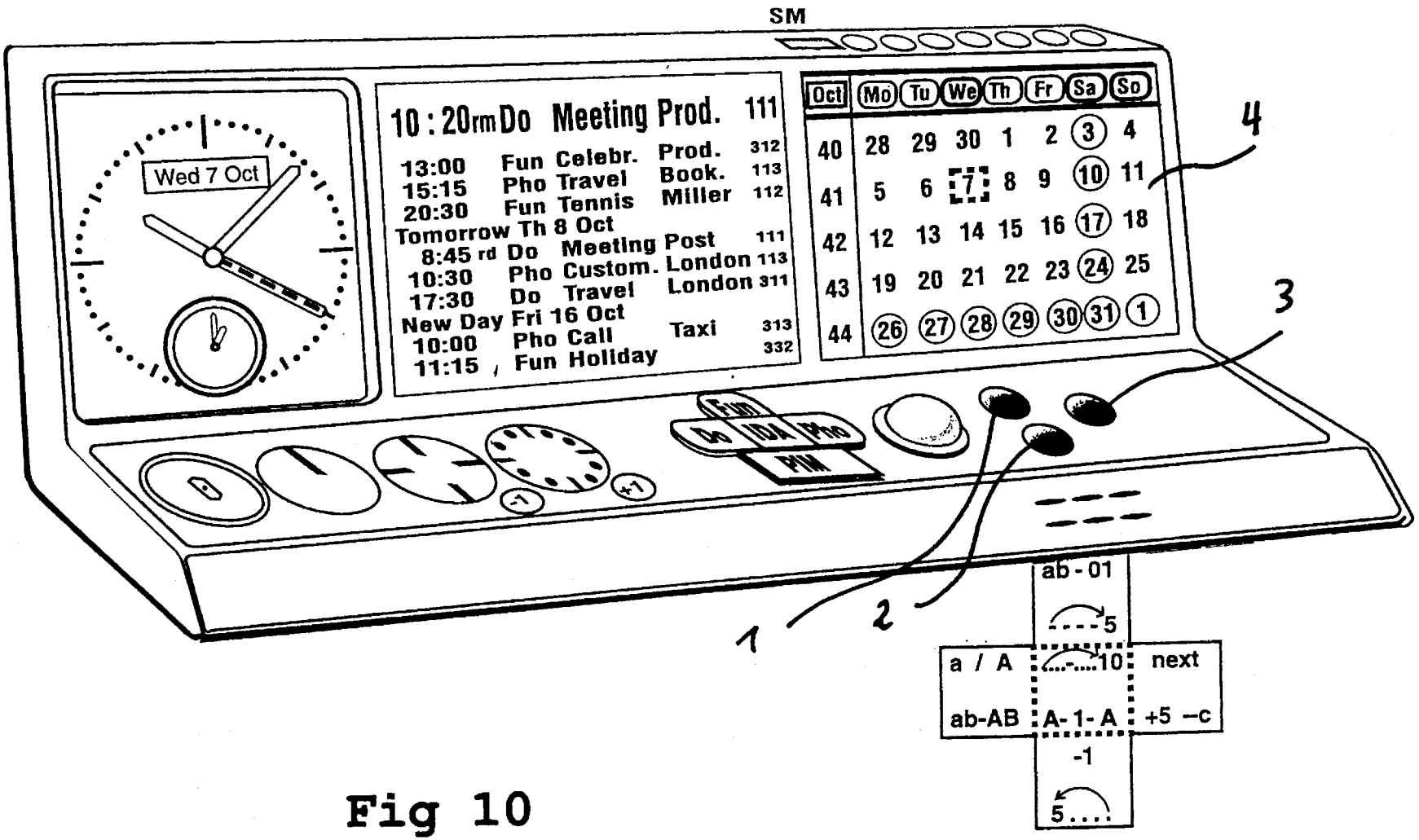
FIG. 10 illustrates a desk-top clock with a month-skipping calendar.

FIG. 10 illustrates a desk-top clock which is provided with the elements already known:

the "triple analog display",
the target time input elements BT1 to BT6,
for activity identification "Do, Fun, Phone"+IDA
programming unit "PIM"
the outlined auxiliary writing means "Write".

The following new elements which should be mainly mentioned here are as follows:

1. "Later"—If an appointment approaches and should be slightly postponed into the future the key "later" is operated. Now the keys BT1 to BT6 can be operated to postpone the appointment to a new target time, starting out from the previously entered time.
2. "Back" element—This element may be operated during the input of an appointment in order to skip back by a single increment, using BT1 to BT6 or a target day input means, for newly entering the appointment by starting out from that earlier time.
3. "Speak" unit for noting acoustical messages along with appointments (acoustic notebook).
4. "Month-skipping calendar" with target day input means (7D) comprising the buttons:

"S M", Mo, Tu, We, Th, Fr, Sa, Su.

There are many different versions of month-skipping calendars for clocks and computer programs. Mostly the cursor is merely moved, however, using the direction keys "left/right" by days along the horizontal and using the keys "up/down" by weeks along the vertical. A target skip over wide distances is therefore not possible. In the form here presented the target day skip keys allow for a smooth and quick skip to the target day, a very rapid jump, using the S or M key, over wide distances to more remote quarters or months, and from there directly to the days of the week.

The two large-size display elements will now be referred to for an explanation of the "identical activity" function of the IDA element. If one wants to know, for instance, whether the activity respectively mentioned in the principal display is scheduled on other days, too (in our case "meeting") the IDA key is operated to activate the digital display of all scheduled meeting appointments.

Moreover, all meeting appointments are additionally indicated by "twelve-segment rings" giving the day and the approximate hour in the month-skipping calendar. A skip to these days by means of the target day skip system shows the details of the agreed dates as well as the subsequent appointments.

This clock allows not only for the extremely rapid entry of appointments within the next few hours or days in the close vicinity, but also for a high-speed noting of highly differentiated appointments, their representation in the most different modes, and a rapid scheduling in ranges even far beyond a year. This clock may also be employed for the communication among persons (superior/secretary, among family members, etc.).

Figure 11A:
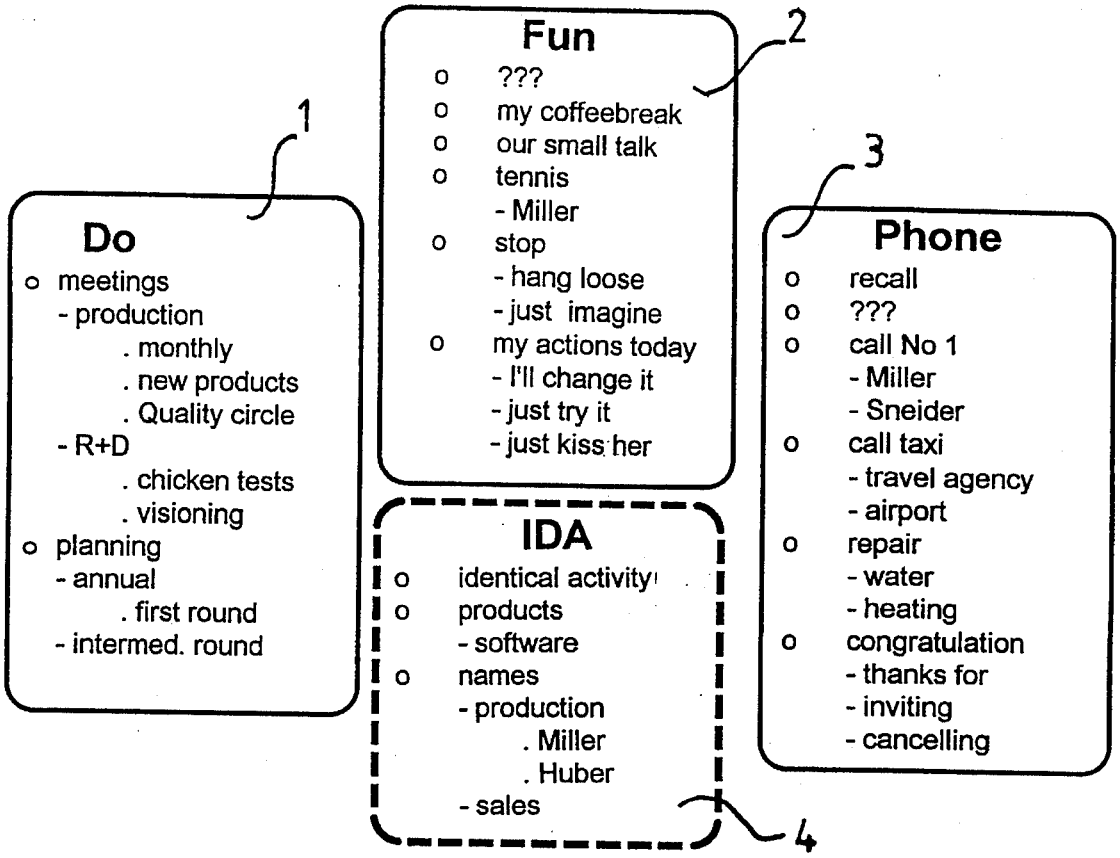
FIG. 11*a* is a view of the texts describing "Do", "Fun", "Phone"+"IDA"

FIG. 11*a* illustrates the panels 1 to 4 resembling the input means "Do, Fun, Phone"+IDA, where activity-descriptive words appear in different groups within a hierarchical structure.

Within three seconds from termination of the target time entry the symbols or words in the module columns 5 or 6 (cf. FIG. 1) may be fetched which are stored by "Do", "Fun" or "Phone". An activity-descriptive supplement may be added, by means of the IDA function, into module column 7.

In the present configuration three hierarchical levels are provided which are termed here level A, level B and level C. If, for instance, the "Do" key is briefly operated three times the cursor jumps to position 3 of line A. By depressing the "Do" key the skipping operation is interrupted for an optional period of time, e.g. for reading. Roughly 0.5 seconds after release of the key the first item of the joining level B flashes which is then reached by depression; then the key may be briefly depressed for continuing the skipping operation and a jump to the level C may be made by waiting for a short period of time. If, for instance, the continued skipping is interrupted at a particular position the previous A item thereabove flashes after one second. If now the key is pressed one can skip forward again to the A level, or optionally a shift may be made from that or any other position to "Fun" or "Phone" and back again to "Do". If, however, there is no response on the aforedescribed flashing A level and if neither the IDA key (module category 7) nor the PIM key (module category 8) is pressed within three seconds the target word "tennis" is assumed to have been fixed, is stored, and then the system returns to the actual time and the input-awaiting status.

It is now entirely left to the user's discretion to build up his own archive according to his needs and ideas, to which end he may use no second level, with merely five activities being envisaged for "Do", "Fun" or "Phone", and restrict himself to or focus on five items only which he considers to be essential. In the case of major and more detailed spheres of activities the system may be extended without any limitations since it is possible to form any number of principal or secondary groups comprising each three, five or ten items. In any case it is expedient to activities occurring most frequently more at the beginning of the spheres "Do, Fun or Phone" and IDA in order to be able to skip to them within seconds, display and store them at an equally high speed. In the present example merely the words "Do", "Fun" and "Phone" are established at item 1 of the three principal spheres and only upon a second operation of the key a specific activity appears which occurs fairly frequently. It is not necessary here to discuss further details of erasure of isolated words or categories by means of the "NEL" function or of line-wise or block-wise modification or supplementing by means of an auxiliary write means. It is certainly not necessary either to show by way of examples that this system may be used, despite the brief waiting units, for a very rapid uncomplicated manual entry by one hand of very sensible additions for supplementing the target time information.

Figure 11B:
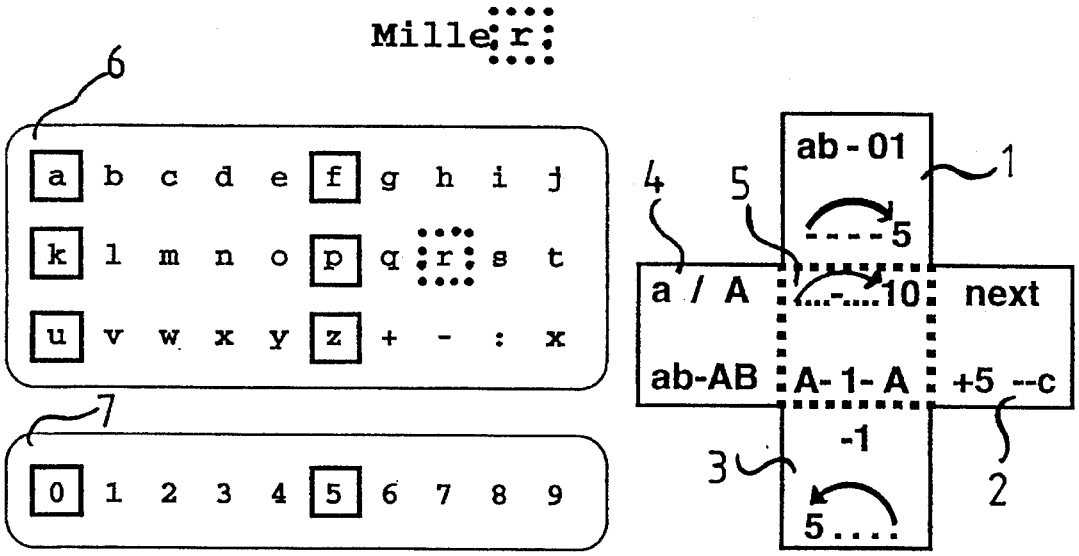
FIG. 11*b* shows the "WRITE" target skip writing system.

FIG. 11*b* illustrates an auxiliary writing system for many types of equipment which are not provided with an alphanumerical keyboard even through the use of words and combinations of numerals would offer great advantages, like in timer cocks of the present kind. WRITE consists of five keys (1), (2), (3), (4) and (5) for the entry of combinations of words or numerals in a display or by a storage code word such as "Do, Fun, Phone" or IDA. The access to this archive is made in the same way as described before, using the main input means—in our case here the top line again—for writing a name such as "Miller". If the line for writing is at the top and if one of the five keys of the WRITE system is operated the alphabet (6) appears therebelow, e.g. arranged in three groups of ten, and the succession of the numerals 0 to 9 (7) is displayed.

The first as well as the fifth character of each line of ten is clearly marked for better orientation. It is then possible to carry out skips in the alphabet and in the line of numerals to reach the desired aim—in the present case the missing "R", jumping by groups of tens (first key operation of key 5), groups of five (second pressure point at key 1) and further units steps from "P" to "R". If a telephone number should be added behind "Miller", for instance, key 2 may be operated to insert "next" twice for inclusion of a blank and then key 5 (second pressure point) is operated to skip to the line of numerals 0 to 9. This line is so arranged that a single key stroke causes 1 to appear and a double stroke displays 2 after 0. After an operation following the numeral 5 a single or double stroke cause the display of 6 or 7, respectively, which means that sensible key operations are provided which are related with the numbers.

The organization of the alphabet in groups of ten or five, respectively, highly facilitates the orientation within the alphabet so that the rapid entry of the letters is much easier than with the "scrolling" technique.

The auxiliary writing system "Write" may be easily used even by non-professionals after a short training period; it may be mounted on the underside or rear side of desk-top clocks etc. or in the form of a withdrawable panel so that it is easy to operate and yet does not create a dominant impression.

Figure 12:
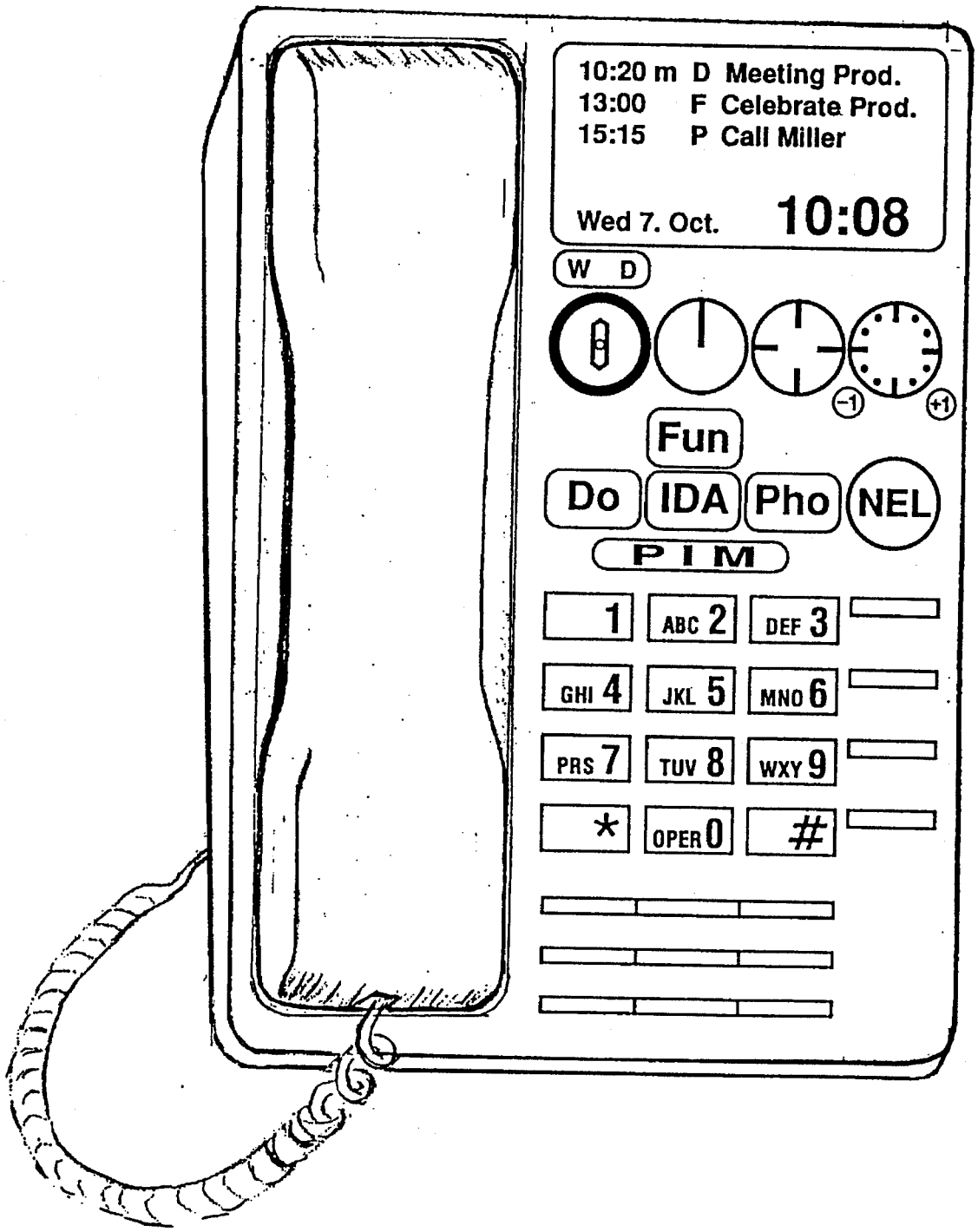
FIG. 12 is a view of a telephone with an alphanumerical timer keyboard.

FIG. 12 shows a telephone set including a numerical keyboard on which the alphabet is indicated in groups of three (ABC) on the numeral keys 2 to 9, as this is frequently the case on an international level. This version, which is not so common in the German-speaking countries, permits, however, a comparatively convenient mode of storing words, too, so that the telephone may be built not only as a plain timer clock but also in the form of a convenient and highly differentiated appointment-reminding clock. This configuration comprises the following essential elements:

"W D" for skipping to the beginnings of weeks and days,
the target time (of the day) skip unit (Bt1–Bt6),
the "Do, Fun, Phone" and IDA unit,
the "PIM" element for differentiating the alarm signals,
the "NEL" element as flashing means,
the alphanumerical auxiliary telephone keyboard.

The combination of a telephone with an appointment-reminding clock presents the great advantage that during a telephone discussion a highly differentiated agreement may be easily made by entering, with one finger of the free hand, the target time and by fetching all further elements from the modules "Do, Fun, Phone"+IDA and PIM.

Figure 13A:
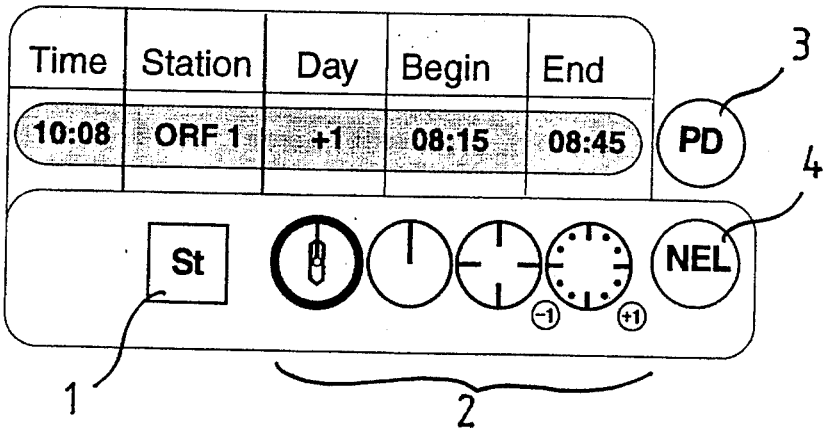
FIG. 13*a* illustrates a clock for controlling technical equipment.

FIG. 13*a* shows a simple recording controller, e.g. for a tape recorder. The controller includes, in addition to a 4-element display, three input elements:

(1) the "ST" input means to enter the broadcasting station, which is configured here as a plain button or rotary button. The beginning of the tape recording is easily set in the common way by means of the target time keys (Bt1 to Bt6) in the target skip system (2). Even though in this plain controller a target day keyboard such as "D W" or the target day-of-the-week unit is intentionally dispensed with here it is yet very easy to program and display recordings during the next few days.

If the user operates, for instance, the time-of-the-day button (Bt1) to skip by 6 hours intervals to "tomorrow" and then to the beginning 8:15 a.m., the "+1" button is used to represent "tomorrow", the "+2" button sets "the day after tomorrow", etc. The program duration is entered by means of the rotary program duration switch "PD" (3); in this plain version the recording interval as such is not represented but merely its end. In this manner various recording intervals may be programmed, displayed or even erased by means of the "NEL" (4) button and using the "NEXT—NEXT" function (thumbing through). The NEL button may be designed for flashing to indicate the recording status.

Figure 13B:
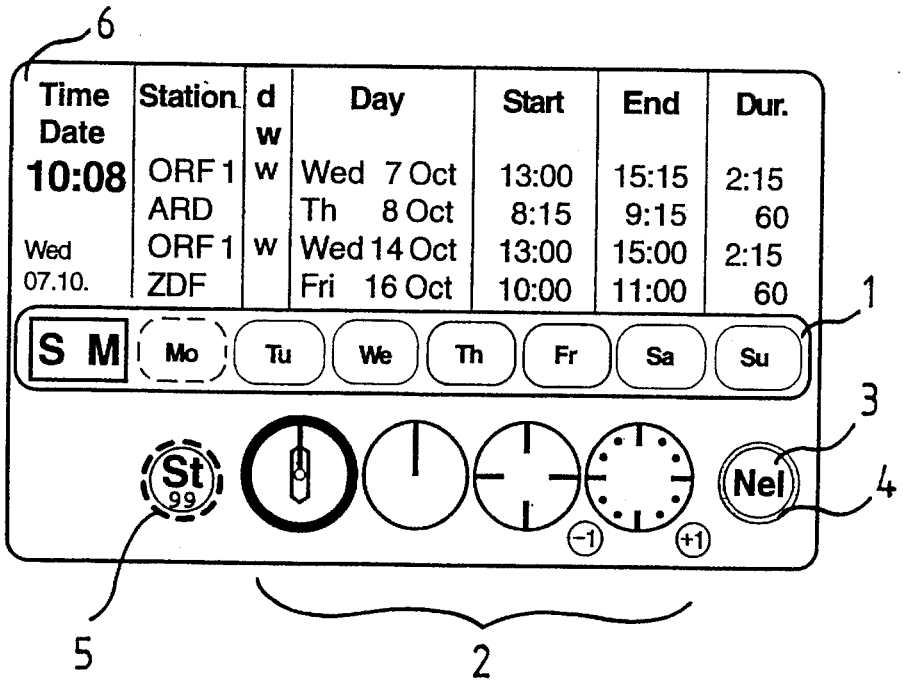
FIG. 13*b* is a programming clock, e.g. for a video recorder.

FIG. 13*b* illustrates a programming clock, e.g. for a video recorder, which is structured on a principle similar to the one illustrated in FIG. 13*a*., but which is much more convenient on account of additional input means and a larger-sized display. Its elements are:

1. The target day input element (7D) allowing also for pre-programming of programs broadcast even in a very remote future,
2. the target time input element (Bt1–Bt6),
3. the "NEL" element with flashing light means, which is mounted in a
4. "program duration" ring (PD) so that this ring may be used for a rapid setting of the program duration without touching on the "NEL" key,
5. "ST 99" for selection among 99 broadcasting stations. ST 99 is designed here as a rotary switch operating at two levels. In the depressed state the tens are selected by rotation; without depression and by rotation the unit is added. However, the display not only indicates the channel number but also the station name as well as an additional information such d (daily) or w (weekly) if such repetitive operation has been programmed by means of the target time input element;
6. and finally the digital display to indicate the time and the date, the station, the series (daily, weekly), the day of the week with the date of the programme, and the start, the end and the duration of the recording interval.

Figure 14A:
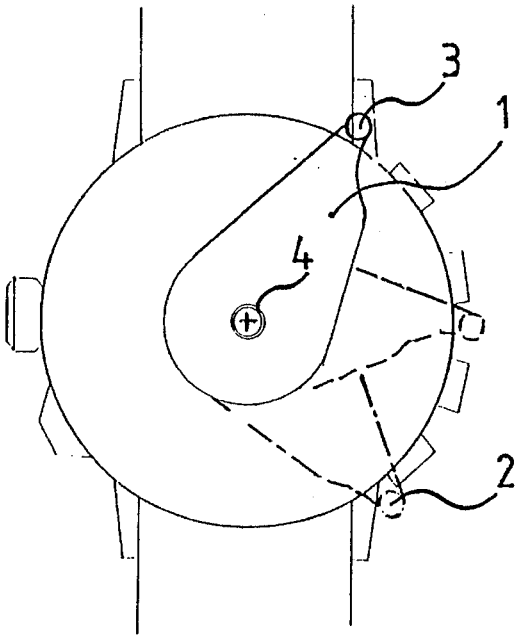
FIGS. 14*a* through 14*b* show a wrist watch with means for mechanical irritation.
Figure 14B:
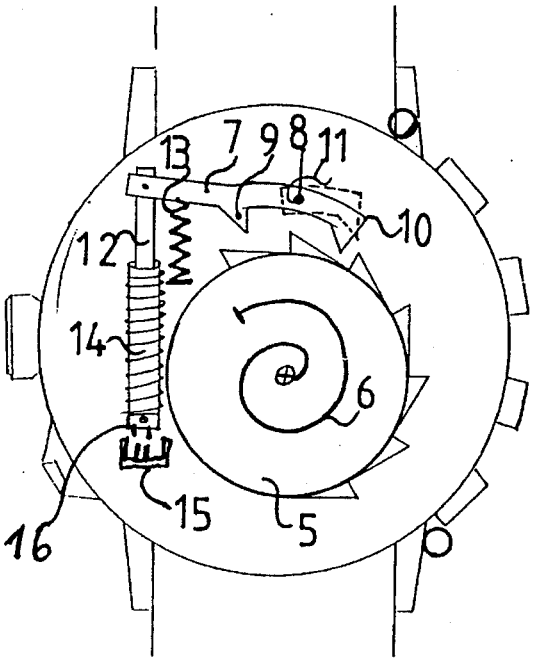

FIGS. 14*a* and 14*b* show a wrist watch including a setting lever (1) on its bottom (FIG. 14*a*) which may be biassed through roughly 90°, i.e. from position (2) to position (3). This lever returns into the initial position (2) upon occurrence of one or several target time(s) by one or several (partial) jumps, thus triggering a reminding stimulus on the wrist, which can be perceived only by the user but not by the persons surrounding him. In accordance with the invention this setting lever is mounted in the centre or eccentrically on the bottom and plugged onto the locking wheel (5) in the clock (sketch II) by means of a molded plug-on element (4) on the inner side of the bottom. This locking wheel may be rotated in opposition to the action of a spring (6). An anchor-type arresting means (7), which is supported on the axis (8), comprises a fixed arresting tooth (9) as well as a locking mechanism (10) equally supported on the axis (8) and held depressed by a spring (11) so as to have the locking wheel arrested by the arresting device in the rest position. The arresting device is connected via an arm to a magnetic core (12) and is retained in its normal position by means of a spring (13).

Upon the occurrence of one or several target times the electromagnet (14) is briefly activated so as to cause the arresting device to rotate, the locking elements to decouple, and to cause the locking wheel to rotate until it is temporarily arrested by the arresting tooth (9) until the spring (13) presses the locking device again into its initial position and the locking mechanism (10) assumes the arresting function for another arresting tooth. It is possible to wind up the setting lever again due to the mobile locking mechanism (10) in the rest position of the arresting device. Depending on the configuration of the locking device and the locking wheel it is possible, for instance, to produce two stimuli, as in FIG. 14*c*, or several stimuli, as in the case of the watch for blind people, which is illustrated in FIG. 14*a*.

Contact needles (15) are provided as retrofit set for a plastic-encased watch, which may be pressed into the magnet. Another retrofitting variant provides for contact needles at the magnet (16) by means of which the contacts may be established by piercing through the plastic enclosure of a watch having a plastic housing.

Figure 14C:
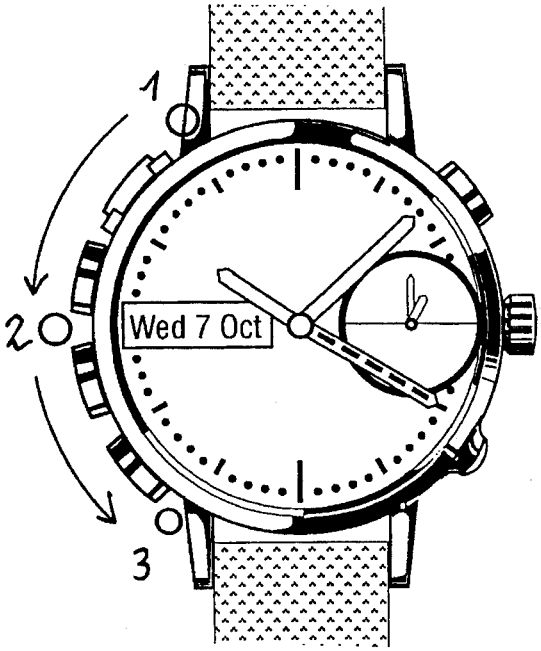
FIG. 14*c* shows a wrist watch with a trailing minutes hand.

FIG. 14*c* shows a wrist watch on which two appointments have been set, one at 10:20 by means of the trailing minutes hand and the second one at 13:00, which is indicated by the trailing date clock. The end of the setting lever is here represented by a round button which may be designed as a red signal, for instance. In the biassed condition it is pressed behind the watchband (position 1). At 10:20 it carries out two jerky movements to jump to position 2 which also indicates that sufficient energy is available for a second reminding signal. At 13:00 this setting lever button jump to position 0 which the user of the watch can clearly see and which indicates that the mechanism should be wound up again.

Figure 14D:
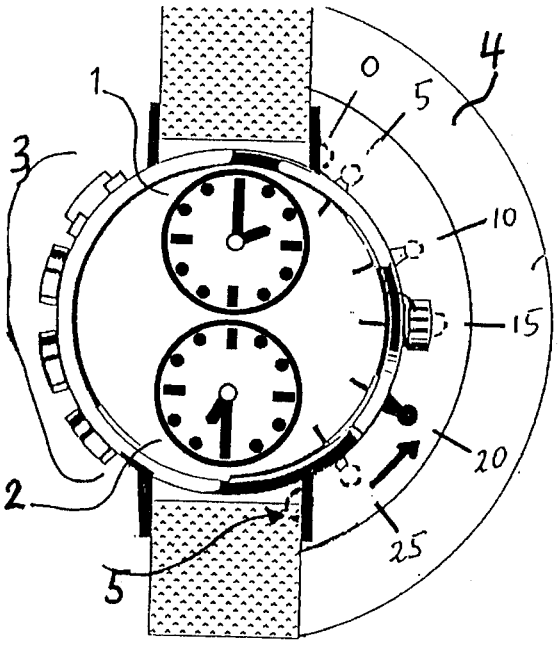
FIG. 14*d* is a view of a watch for blind people, provided with means for appointment signalling by mechanical stimuli.

FIG. 14*d* illustrates a watch for blind persons, which comprises a palpable analog watch (1), a separate and equally palpable trailing date clock (2) and the target time input means BT1 to BT6 (3). The symbols identifying the four buttons (3) of the target time input means (Bt1 to Bt4) are equally provided with a marked relief-type pattern.

The "NEL" key is integrated into the winding crown as pressure switch. Sine a trailing minutes hand (MSZ) would produce an annoying effect on a watch for blind persons during the current hour of the appointment, and would moreover be highly complicated to sense, a reminding minutes hand is mounted in the form of a setting lever on the bottom plate, instead of the trailing minutes hand. This setting lever is provided in the scale (4) at position 0 in rest position. From there it is tensioned clockwise over the 25 minutes position and pressed behind the watchband (5). 25 minutes prior to the occurrence of the time of the event the setting lever jumps out from behind the watchband, sets itself to the "25 minutes" position and then jumps in jerks, e.g. every 5 minutes, backward to the next position until it reaches the rest position 0. The reminding setting minutes hand thus allows for a discrete pre-signalling. An acoustic alarm is produced only if the physical stimuli should not have been perceived. With the user very quickly getting accustomed to the function and position of the target skip input means Bt1 to Bt6, even a "blind" entry of the target time is unproblematic and as rapid as the entry under visual control.

Thus here, too, the system-overlapping and almost universal applicability of the target time skip technique is documented.

FIG. 15 shows a clock suitable for users such as elderly people who even though their mental capacity is still unimpaired suffer from a reduction of sight and who encounter problems already in handling small buttons and operating elements. A plain and clear face, broad hands, large-size buttons, clearly legible fonts, an intensely flashing NEL light, a clearly voiced, acoustic reproduction of words and, above all, also large-size target time input keys (BT 1 to BT4) provided with relief-pattern symbols are essential for use. The clock is expediently equipped with an acoustic unit which reproduces the actual time, the time interval from the actual time to the set time of an appointment, and individualized voice recordings which may be composed, by a modular pattern, to form sensible units of reminding information.

Figures 15A, 15B:
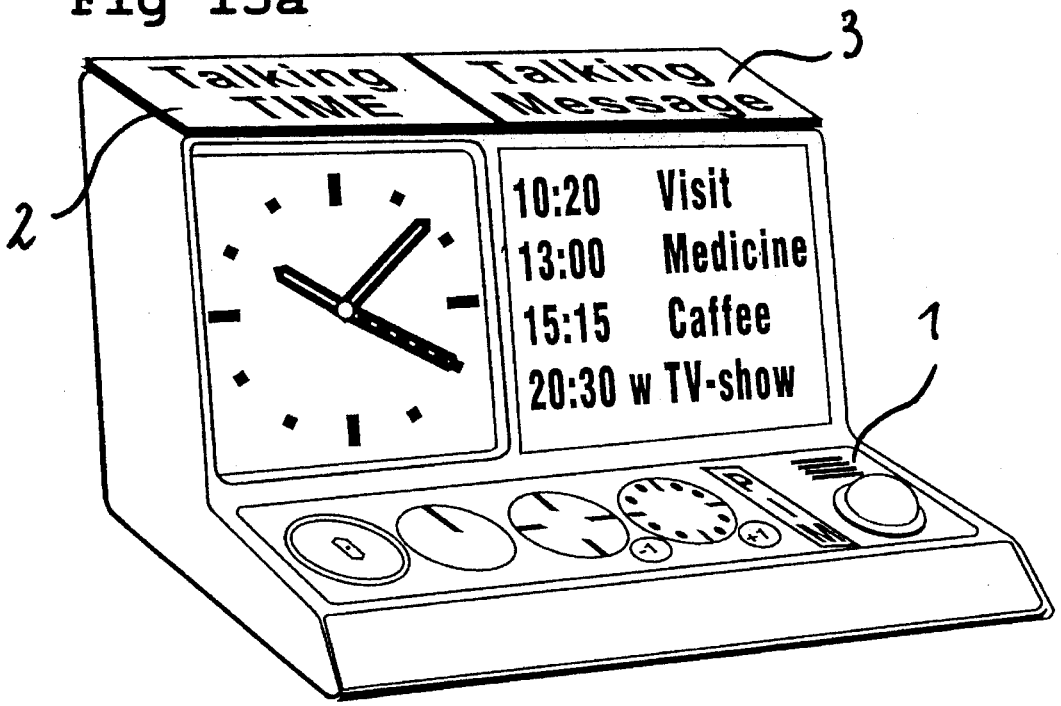
FIG. 15*a* is a view of a clock for elderly people.
FIG. 15*b* is a chart of voice messages for time and appointments.

FIG. 15*a* shows a clock which, in accordance with the invention, is provided, in addition to the known display and input elements, with three characteristic features:

1. language input means "speak"
2. large-size button for "speaking time"
3. large-size button for "speaking message".

FIG. 15*b* is a block diagram indicating such feature in the form of five different sentence patterns (SM). In this example they refer to the administration of medicine, with each sentence pattern consisting of eight modules, for instance, which may be introduced and finished by sounds via the modules 1 and 8. The sentence modules 2, 4 and 6 may be pre-programmed. Module 2 represents the time while module 3 furnishes the respective difference from the target time or the target time directly. Module 7—here: taking medicine" is recorded through the language input element "speak" after the time has been fetched via the main input means BT1 to BT6 and the written text has been input via the input means "WRITE" or fetched from the memory.

Instead of the programmed modules for the various sentence patterns these modules may also be composed by the user himself in another version appropriate for language input so that instead of a third party's voice the voice of an acquainted person may be heard.

FIG. 16*a* shows a mini-organizer and calculator having the format of a credit card and provided with an alphanumerical keyboard. A rapid input of times and activities is here difficult and troublesome on account of the great number and the very small size of the keys.

It has become evident that the credit card format is sufficient for accommodating all four main target skip systems ("4 Z S" keyboard), the target day keys, the target time input means, the activities differentiators with "Do, Fun, Phone" and IDA as well as the MIP key, together with the NEL element, which is always associated therewith, and even for arranging them in the same groups as those sensible for large-size clocks.

This illustration serves to show, not only for the credit card format but equally also for the wide range of so-called "palmtops", that the target skip system may be applied even in a small space and yet in a very clear arrangement which is easy to use—i.e. in the sense of the invention—such that it encompasses several systems.

FIG. 16*b* is the view of an "organizer" similar to the device according to FIG. 16*a*. One solution to the problem of troublesome entry of appointments, without illustrating the keyboard beside, can be realized in accordance with the invention in a way that merely the labelling of the target day input on the "4 ZS" keyboard is visible at the upper edge on the front side FIG. 16*b* of the organizer.

The complete keyboard is accommodated on the rear side in a mirror arrangement (shown here in a through-view, FIG. 16*c*).

The bordering of the individual buttons is finished by fine relief lines which are palpable with the tips of the fingers. If the organizer is held, for instance, in the left hollow hand the target time and the activity keys may be operated by the index and middle fingers of the other hand, pressing through either from the top or from the bottom.

The target day key (see FIG. 16*d*) may be easily and precisely operated by the thumb and the index finger.

Figure 17A:
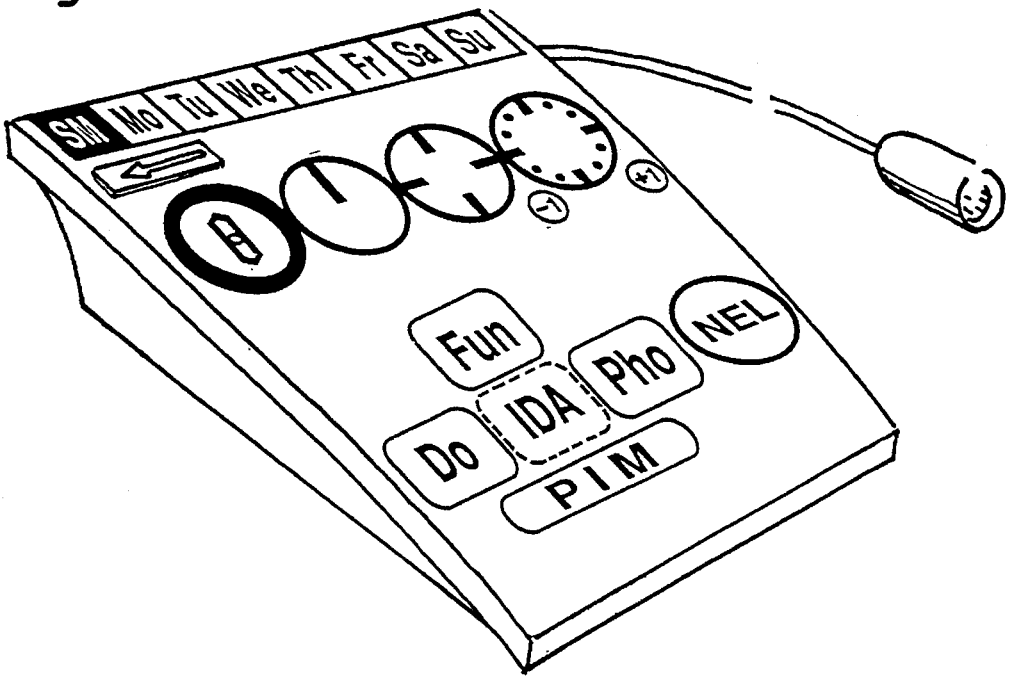
FIG. 17*a* is a view of an appointment entry keyboard for EDP equipment.

FIG. 17*a* shows a supplementary keyboard which may be used in addition to a standard keyboard and may be connected to a serial computer interface. The programs for this "4 ZS" keyboard are fundamentally organized on the basis of the hierarchical target skip system. Thus the vast majority of all activities may be fetched, programmed and managed within the shortest time possible, using a single finger, and may be supplemented without any delay by the entry of an additional text via the normal keyboard. One variant of this keyboard as well as of the keyboards described below is so configured that it is provided with an appropriate supplementing hardware as well as displays and a separate power supply so that the immediate availability is ensured, even when the computer is switched off, for entering new appointments within seconds.

Figure 17B:
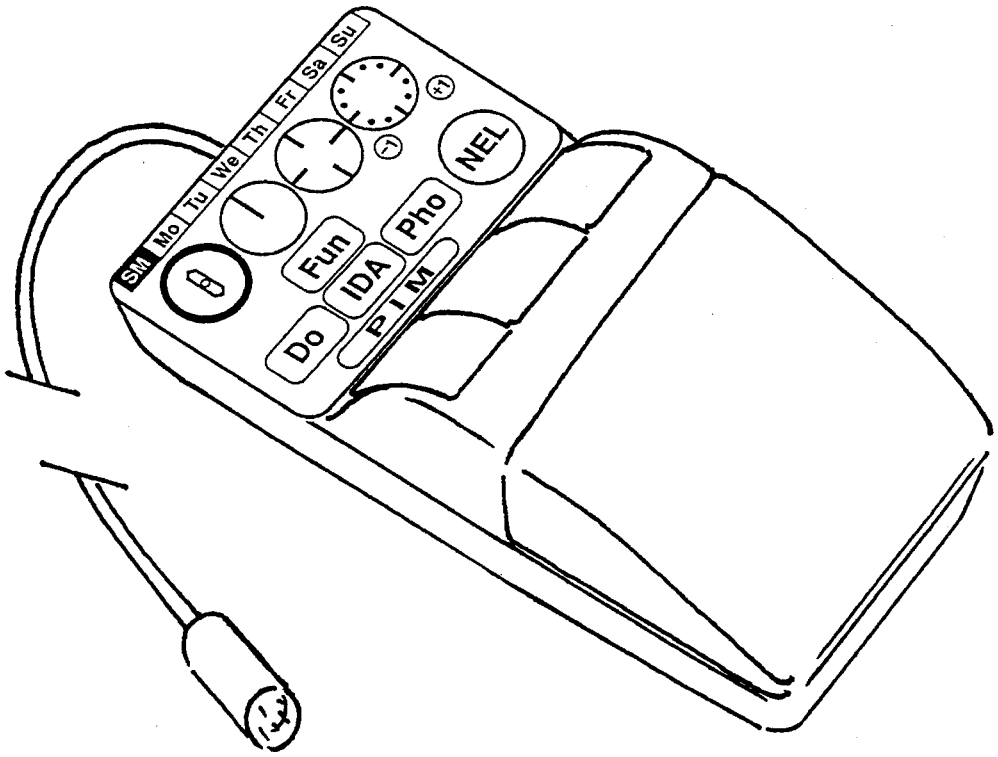
FIG. 17*b* shows a combination of a mouse with a keyboard.

FIG. 17*b* illustrates fundamentally the same "4 ZS" keyboard, even though in combination with a three-key mouse in accordance with the invention.

This configuration may be expedient in the event of computers which do not have sufficient unallocated serial interfaces, or for computer programs which have been designed for the target skip system, however, with the simultaneous employment of the mouse.

FIG. 18*a* shows a "4 ZS" keyboard for accommodation in the diskette drive which, seen in the direction of introduction, is by roughly 8 mm smaller than a common 3.5" diskette. In accordance with the invention that side of the keyboard (1) which is inserted first into the diskette slot and rails FIG. 18*b* presents a smooth finishing so that it moves the biassed triggering arm inside the insertion slot but prevents this arm from releasing the locking of the diskette readers. Thus the latter remains in resting position above the diskette, without being damaged. In order to avoid that the diskette will be ejected again from the rails (2) the rims of the keyboard are provided with resilient braking recesses (3) for compensating the spring pressure of the triggering arm.

In order to ensure that the keyboard will not slide behind a possibly incorrectly mounted diskette drive front panel locking projections (5) are provided. Grasping notches (6) facilitate the removal of the diskette keyboard from the drive module. Since the frame of the keyboard (7) is slightly higher than the keyboard as such the aperture flap in the drive front panel is held in an elevated position so that it will not rest on the input keys. The "4 ZS" keyboard may be connected via the contact bar (8) and the contact slide (9) by means of connecting cables to the serial computer interface. For reasons of insufficient space notebooks and laptops are normally not provided with a numerical keyboard. Such a keyboard may be accommodated on the rear side (see FIG. 18*c*) of the "4 ZS" keyboard with the size same as keyboard on normal computers. Thus the drive slot is a space-saving shipping container for one or two keyboards.

FIG. 18*d* shows a pen mouse in the form of a specifically configured triangular rod which is held in the hand like a thick pencil. It is supported from below by the ring finger and held between the middle finger and the thumb. The ring finger rests in a recess (1) of the right edge which is precisely opposite to the left surface where the thumb produces the holding pressure. Thus the index finger is free for operation of the pen mouse keys (2) which, for ergonometric reasons, are disposed in an oblique position so as to be easy to operate. The target day keyboard (3) is provided on the right side of the triangular surface and is opposed by the target time keyboard, the target activities keyboard (Do, Fun, Phone+IDA) as well as the PIM and NEL units on the left side (4).

The cable for connection to the serial computer interface is mounted on the end of the rod with this configuration. Target times and activities can be easily programmed in three ways. First of all by means of the left hand while the right hand invariably holds the mouse pen. Secondly as a resting two-plane keyboard, in which case great skills are achieved if one finger uses the upright edge as a guiding bar for the other fingers. In the third variant FIG. 18*e* the timer rod is held by the left hand. The edge opposite to the keyboard surface slides on the right palm of the hand while the right thumb may be used for a very rapid and highly selective programming. Since this multi-functional mouse is highly space-saving and has a format not much greater than a bundle of three pencils it is well suitable for travelling with notebooks and laptops.

With the present highly uncommon shape of a triangular rod, too, the target skipping date entry system may be used in a way encompassing several systems.

Figure 19A:
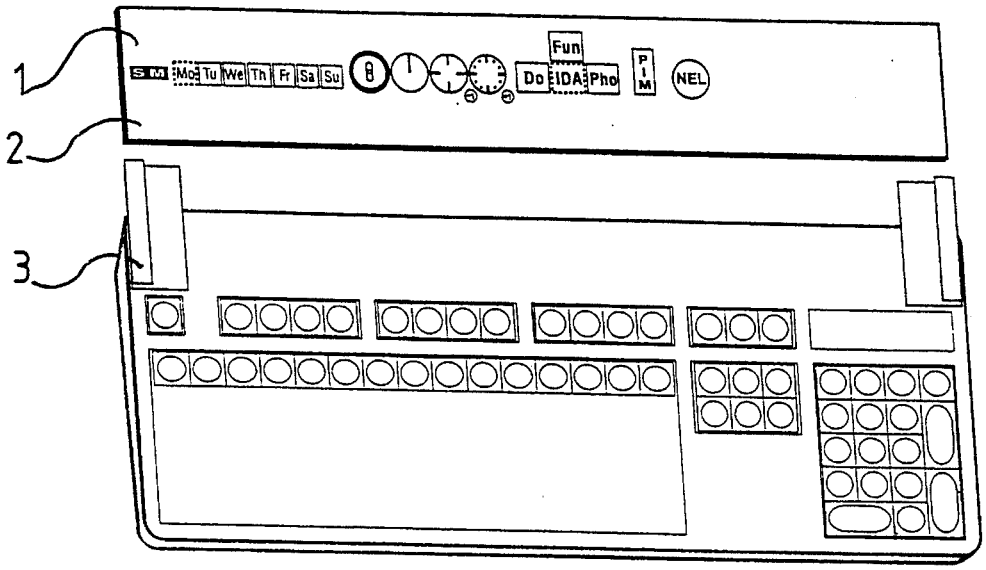
FIG. 19*a* illustrates an appointment entry keyboard for retrofitting standard keyboards.

FIG. 19*a* shows a "4-ZS" retrofit keyboard on a strong plate sheet (1) provided with a connecting cable for connection to a serial computer interface. The lower part of the keyboard (2) is left free for placing there a stencil explaining the 12 function keys of the standard keyboard. On the upper part of the keyboard retainers (3) are applied by means of self-adhesive films for insertion of the "4-ZS" keyboard. In this way it is possible to retrofit practically any standard keyboard with the "4 ZS" keyboard.

A second variant of this embodiment of a "4-ZS" retrofit keyboard includes a digital display as well as the appropriate hardware and a chargeable battery unit in the form of a rod which may be adhesively fixed behind the retrofit keyboard on the standard keyboard. In this case the connection is established via a branch of the principal keyboard interface.

Figure 19B:
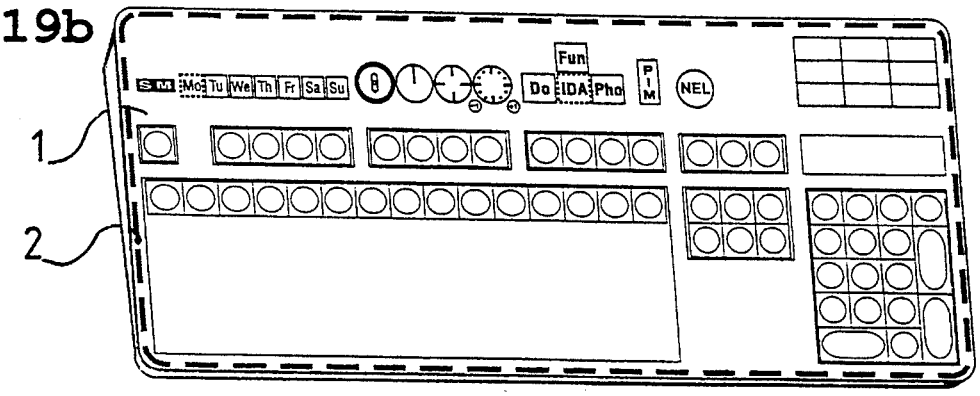
FIG. 19*b* is a view of a standard keyboard with an appointment entry keyboard integrated therein.

FIG. 19*b* shows the combination of a standard keyboard with a "4-ZS" keyboard as one unit. It presents as essential features: a free strip (1), 20 mm wide, for placing the program-specific explanatory stencil for the function buttons 1 to 12. A mounting groove (2) borders the entire keyboard and may be provided with a retrofit luminous band for indication of approaching appointments or other events by varying lights. The keyboard includes a retrofit panel (3) above the numerical keyboard for optional mounting of a retrofit supplementary keyboard, which may be labelled e.g. in a six-element form, or a "AT" clock for time and appointment indication when the computer is switched off.

In another variant it is also conceivable to provide a retrofit LCD display which is supplied with power from a chargeable battery connected to the keyboard voltage.

Figure 19C:
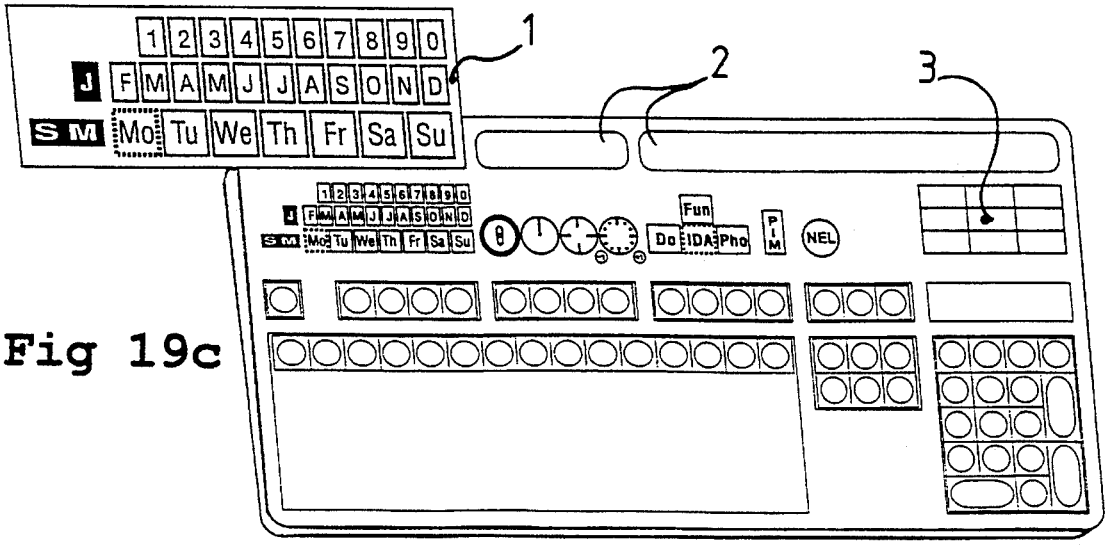
FIG. 19*c* shows a keyboard for long-term scheduling.

FIG. 19*c* equally shows the combination of a standard keyboard with the target skip system, however for large companies, institutions and planning establishments which handle every day medium- and long-term projects.

For instance, in addition to the normal elements for the differentiated entry of appointments mainly the complete target day time skip system with the three target skip units (10Y), (12M), (7D) (cf. enlarged view) is integrated, which is also illustrated in FIG. 1, in order to be able to have direct access to projects or to have certain years, months or days displayed.

Moreover, various supplementary displays (3) for additional information as well as six to eight supplementary keys (4) are provided which may be freely programmed and labelled for the planning and scheduling work. In control terminal keyboard or for industrial process controllers programs may be fetched also from the Do module, instead of the PIM module, and additionally supplemented or rendered more specific in many ways by means of the IDA function.

I claim:

1. A time piece for the storage of specified future target times comprising:

a clock for measuring time;

an actual time display;

a target time display; and an input unit comprising first, second and third inputs of first, second and third target periods, respectively, wherein each target period comprises a beginning and an end, and wherein said target periods comprise integer multiples and/or integer fractions of well known segments of time, wherein each operation of said inputs advances the target time displayed to the beginning of the next target period corresponding to the operated input.

2. A time piece according to claim 1 wherein said first target period comprises a multiple of a divisor of 24 hours;

said second target period comprises a multiple of an hour; and said third target period comprises a multiple of a divisor of sixty minutes.

3. A time piece according to claim 2, further comprising a fourth input of a fourth target period, wherein said fourth target period comprises a multiple of another divisor of sixty minutes.

4. A time piece according to claim 3 wherein said first target period comprises six hours, said third target period comprises fifteen minutes, and said fourth target period comprises five minutes.

5. A time piece according to claim 1 wherein:

said first target period comprises a day, said second target period comprises a week, said third target period comprises a month, and further comprises:

a fourth input of a fourth target period comprising a quarter of a year, and a fifth input of a fifth target period comprising a year.

6. A time piece according to claim 1 wherein said actual time display comprises an analog display comprising hour and minute hands, and further comprises a trailing minute hand which emerges from behind the minute hand of said actual display at a defined point of time prior to the target time which takes the position of the target time on the analog display.

7. A time piece according to claim 6 wherein said trailing minute hand carries out signaling movements and/or circular movements to signal a target time at a later point of time than said defined point of time prior to the target time.

8. A time piece according to claim 6 wherein said actual time display comprises an analog display, and said target time display comprises an analog trailing date clock display to signal target times at a point of time prior to the target time.

9. A time piece according to claim 8 wherein said analog trailing date clock comprises a secondary display of a second subsequent target time, wherein said analog trailing date clock supplements said trailing minute hand wherein said trailing minute hand indicates an immediately approaching target time.

10. A time piece according to claim 1 wherein said time piece comprises a wrist watch and further comprises at least one luminous switch unit which signals the approach of a target time by emitting light onto the wrist and/or to the side opposite to the wrist.

11. A time piece according to claim 1 wherein said target time display comprises a setting lever mechanism which is adapted to be triggered in response to the approach of an entered target time and which signals the occurrence or the immediate approach of the target time.

12. A time piece according to claim 11 wherein said setting lever projects a prominent signalling head as a pointer, and advances counterclockwise and/or skips to signal target times and/or residual target periods which may be read on the target time display.

* * * * *

UNITED STATES PATENT AND TRADEMARK OFFICE

CERTIFICATE OF CORRECTION

PATENT NO : 5,619,477

DATED : April 8, 1997

INVENTOR(S) : U. Martin Schenk

It is certified that error appears in the above-identified patent and that said Letters Patent is hereby corrected as shown below:

The drawing sheet 1 of 19, should be deleted to be replaced with the drawing sheet, consisting of Fig. 1, as shown on the attached pages.

Signed and Sealed this

Second Day of December, 1997

*Attest:*

*Attesting Officer*

Bruce Lehman

BRUCE LEHMAN

*Commissioner of Patents and Trademarks*